US009480311B2

(12) United States Patent
Takani et al.

(10) Patent No.: US 9,480,311 B2
(45) Date of Patent: Nov. 1, 2016

(54) SLIDE FASTENER WITH SIMPLE LOCKING MECHANISM

(75) Inventors: Go Takani, Toyama (JP); Masayoshi Kojima, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/006,990

(22) PCT Filed: Mar. 24, 2011

(86) PCT No.: PCT/JP2011/057226

§ 371 (c)(1),
(2), (4) Date: Sep. 24, 2013

(87) PCT Pub. No.: WO2012/127688

PCT Pub. Date: Sep. 27, 2012

(65) Prior Publication Data

US 2014/0013548 A1 Jan. 16, 2014

(51) Int. Cl.

| | |
|---|---|
| ***A44B 19/24*** | (2006.01) |
| ***A44B 19/30*** | (2006.01) |
| ***A44B 19/06*** | (2006.01) |

(52) U.S. Cl.

CPC ..... *A44B 19/30* (2013.01); *A44B 19/06* (2013.01); *A44B 19/24* (2013.01); *A44B 19/303* (2013.01); *Y10T 24/2511* (2015.01)

(58) Field of Classification Search

CPC ..... A44B 19/30; A44B 19/06
USPC ..... 24/387, 388, 403, 405, 413, 415, 418, 24/433, 436

See application file for complete search history.

(56) References Cited

U.S. PATENT DOCUMENTS

| | | | | |
|---|---|---|---|---|
| 1,890,336 | A * | 12/1932 | Nodine | 24/418 |
| 2,077,360 | A | 4/1937 | Gilmore | |
| 2,584,916 | A * | 2/1952 | Poux | 264/161 |
| 2,644,995 | A * | 7/1953 | Morin | 24/405 |
| 2,720,015 | A * | 10/1955 | Morin | 24/405 |
| 2,901,802 | A * | 9/1959 | Morin | 24/405 |

(Continued)

FOREIGN PATENT DOCUMENTS

| | | | |
|---|---|---|---|
| CN | 101411553 | A | 4/2009 |
| EP | 62878 | A1 | 10/1982 |

(Continued)

OTHER PUBLICATIONS

Supplementary Partial European Search Report, European Patent Application No. 11861781.0, mailed Jun. 23, 2015.

(Continued)

*Primary Examiner* — Robert J Sandy
*Assistant Examiner* — Jason W San
(74) *Attorney, Agent, or Firm* — Kilpatrick Townsend & Stockton LLP

(57) ABSTRACT

In a slide fastener, at least one stopping element including a resistance portion that increases sliding resistance by being brought into contact with an inner surface of a slider when the slider is sliding is locally disposed locally on an element row of a fastener stringer. Accordingly, the slider can be stopped at any position where the stopping element is disposed arbitrarily on the element row and an immobilized state of the slider can be maintained. By operating the slider with a force greater than the sliding resistance to the stopping element, the slider can be made to ride over the resistance portion of the stopping element and to slide along the element row.

15 Claims, 13 Drawing Sheets

(56) References Cited

U.S. PATENT DOCUMENTS

| | | | | |
|---|---|---|---|---|
| 3,082,501 | A * | 3/1963 | Brown | 24/389 |
| 3,086,269 | A * | 4/1963 | Taylor | 24/436 |
| 3,114,952 | A * | 12/1963 | Morin | 24/410 |
| 4,490,889 | A | 1/1985 | Yoshida | |
| 4,502,190 | A * | 3/1985 | Inamura | 24/389 |
| 4,562,622 | A | 1/1986 | Takabatake | |
| 5,713,110 | A * | 2/1998 | Covi et al. | 24/431 |
| 7,464,445 | B1 * | 12/2008 | Lin | 24/415 |
| 7,565,722 | B2 * | 7/2009 | Kusayama et al. | 24/436 |
| 7,650,674 | B2 * | 1/2010 | Miyazaki et al. | 24/424 |
| 8,359,717 | B2 * | 1/2013 | Yamamoto et al. | 24/411 |
| 2002/0178552 | A1 * | 12/2002 | Lin | 24/418 |
| 2003/0177617 | A1 * | 9/2003 | Kita et al. | 24/415 |
| 2003/0182774 | A1 * | 10/2003 | Lin | 24/436 |
| 2004/0020018 | A1 * | 2/2004 | Tsaur | 24/436 |
| 2004/0078942 | A1 * | 4/2004 | Hamada | 24/436 |
| 2006/0260104 | A1 * | 11/2006 | Himi | 24/403 |
| 2007/0137006 | A1 * | 6/2007 | Mikuma et al. | 24/403 |
| 2007/0277353 | A1 * | 12/2007 | Kondo et al. | 24/403 |
| 2009/0049658 | A1 | 2/2009 | Takasawa et al. | |
| 2009/0094805 | A1 | 4/2009 | Keyaki et al. | |
| 2009/0106952 | A1 * | 4/2009 | Lin | 24/418 |
| 2009/0320250 | A1 * | 12/2009 | Yamamoto et al. | 24/389 |
| 2011/0041297 | A1 * | 2/2011 | Iwase | 24/418 |
| 2011/0197403 | A1 * | 8/2011 | Keyaki et al. | 24/418 |
| 2012/0117766 | A1 * | 5/2012 | Damon et al. | 24/415 |
| 2012/0284971 | A1 * | 11/2012 | Roberts | 24/415 |
| 2013/0007993 | A1 * | 1/2013 | Kozato et al. | 24/415 |
| 2014/0020217 | A1 * | 1/2014 | Kojima et al. | 24/436 |

FOREIGN PATENT DOCUMENTS

| | | | |
|---|---|---|---|
| EP | 0094690 | A1 | 11/1983 |
| EP | 97362 | A1 | 1/1984 |
| EP | 1723868 | A2 | 11/2006 |
| EP | 2050349 | A2 | 4/2009 |
| GB | 2021190 | A | 11/1979 |
| GB | 2096693 | A | 10/1982 |
| GB | 2123082 | A | 1/1984 |
| JP | 162709/1982 | | 10/1982 |
| JP | 134916/1983 | | 9/1983 |
| JP | 195509/1983 | | 12/1983 |
| JP | 7-213311 | A | 8/1995 |
| JP | 2004-41440 | | 2/2004 |
| JP | 2009-95370 | A | 5/2009 |
| JP | 2009-95425 | A | 5/2009 |
| KR | 10-2009-0038355 | A | 4/2009 |

OTHER PUBLICATIONS

International Search Report, PCT Application No. PCT/JP2011/057226, mailed Jun. 28, 2011.

* cited by examiner 51
51e
51a 52
52e
52a 53
53e
53a 54
54e 55
55e 56
56e 57
57e

58

59
59a
59g
59f 60
60a
60e
60g
60f 61
61a
61f 62
62a
62h 63
63e
63j
63a
63i

SLIDE FASTENER WITH SIMPLE LOCKING MECHANISM

This application is a national stage application of PCT/JP2011/057226 which is incorporated herein by reference.

TECHNICAL FIELD

The invention relates to a slide fastener in which a slider can be stopped at a predetermined position of an element row, and in particular, relates to a slide fastener with a simple locking mechanism capable of locking a free slider not equipped with a locking pawl at a predetermined position of an element row.

BACKGROUND ART

A slide fastener is conventionally attached to an opening of various kinds of clothes and bags and the opening is opened/closed by operating a slider disposed on the slide fastener to slide to cause left and right element rows to couple or separate. In addition, a slide fastener attached to the front body of clothes and comprising a separable bottom end stop capable of pulling apart left and right fastener stringers after the slider being made to slide to one end of an element row disposed in the fastener is known.

An example of the slide fastener equipped with such a separable bottom end stop is disclosed in Japanese Patent Application Laid-Open Publication No. 2009-95425 (Patent Document 1). For example, as shown in FIG. 14, a slide fastener 20 described in Patent Document 1 is a slide fastener capable of opening from both end sides in a length direction.

The slide fastener 20 includes first and second fastener stringers 21 left and right including an element row 24, first and second sliders 22*a*, 22*b* back and front that can be slid along the element row 24, left and right stops disposed on one end side (front end side) of the element row 24, an insert pin 25 fixed to the other end side (back end side) of the element row 24 in the first fastener stringer 21, and a box pin 26 fixed to the other end side (back end side) of the element row 24 in the second fastener stringer 21.

The first and second fastener stringers 21 each have a fastener tape 23 in which a core thread portion 23*a* is disposed on a tape side edge and a plurality of fastener elements 24*a* constituting the element row 24 and the plurality of fastener elements 24*a* is attached to tape side edges opposed the fastener tapes 23 each other at predetermined intervals.

The first slider 22*a* is disposed forward than the second slider 22*b* and the first and second sliders 22*a*, 22*b* are configured as so-called free sliders including a slider body and a tab held rotatably on the slider body. The slider body includes upper and lower blades, a connecting post connecting one ends of the upper and lower blades, left and right flange portions extending from left and right side edges of the upper and lower blades in a direction closer to each other, and a tab mounting post provided upright in a gate shape on the upper surface of the upper blade.

In addition, left and right shoulders are provided across the connecting post at one end of the slider body and a posterior orifice is provided at a back end of the slider body. Further, an element guide passage in a substantially Y shape communicating the left and right shoulders and the posterior orifice is disposed between the upper and lower blades. In this case, the first and second sliders 22*a*, 22*b* are inserted into the element row 24 in such a way that the respective posterior orifices are opposed to each other.

The insert pin 25 in Patent Document 1 includes an insert pin body 25*a* in a substantially prismatic shape fixed to the fastener tape 23, a projecting portion 25*b* projecting toward the box pin 26 in an end region on the side of the element row 24 of the insert pin body 25*a*, and a protruding portion 25*c* protruding forward from the tip portion of the projecting portion 25*b*.

On the other hand, the box pin 26 includes a box pin body 26*a* fixed to the fastener tape 23, a stopper portion 26*b* in a hook shape disposed at a lower end of the box pin body 26*a*, a projecting portion 26*c* projected toward the insert pin 25 from the side face opposed to the insert pin 25 of the box pin body 26*a*, and a protuberance 26*d* rising to the surface of an upper end of the box pin body 26*a*.

The slide fastener 20 in Patent Document 1 as described above has the first and second sliders 22*a*, 22*b* disposed by opposing the posterior orifices each other so the slide fastener 20 is configured to be able to separate the left and right element rows 24 in an coupled state not only from one end (front end) of the element rows 24, but also from the other end (lower end).

Particularly in Patent Document 1, the box pin 26 has the protuberance 26*d* rising from the box pin body 26*a* and thus, when the first and second sliders 22*a*, 22*b* are made to slide up to the terminal position (lower end position) on the side of the box pin 26 and held on the box pin 26, the protuberance 26*d* of the box pin 26 is closely in contact with the inner surface of the slider body of the first slider 22*a* to increase a frictional force of the first slider 22*a* with respect to the box pin 26.

Accordingly, when the first slider 22*a* is stopped at a predetermined position of the box pin 26, the first slider 22*a* is held at the stop position to stabilize the position of the first slider 22*a* relative to the box pin 26 and also the first slider 22*a* can be inhibited from freely sliding from a state in which the first slider 22*a* is held on the box pin 26.

Therefore, for example, when an operation to insert the insert pin 25 into the first and second sliders 22*a*, 22*b* is performed, an effect of being able to prevent the positions of the first and second sliders 22*a*, 22*b* from being displaced and to smoothly insert the insert pin 25 into the sliders without being caught by the first slider 22*a* or the second slider 22*b*.

Incidentally, some conventional slide fasteners have various functions depending on products (products provided with fastener) in which the slide fastener is used. For example, a slider of a slide fastener used in clothes and the like in which the slider is equipped with a stopping mechanism capable of holding the slider at the stop position of an element row when sliding along the element row is stopped is known.

An example of the slider equipped with a stopping mechanism is disclosed in, for example, Japanese Patent Application Laid-Open Publication No. 2009-95370 (Patent Document 2). The slider described in Patent Document 2 has a locking pawl body disposed in an element guide passage of the slider body so as to allow the locking pawl to advance or retreat and the locking pawl body is attached to the slider body in such a way that a portion of the locking pawl body (locking pawl portion) is allowed to advance into the element guide passage by being energized by a plate spring member.

Ina slider of Patent Document 2 comprising such a locking pawl body, when the slider is made to slide by operating a tab, the tab raises the locking pawl body against energization of the plate spring member to retreat the locking pawl portion from the element guide passage and therefore, the slider can smoothly be slid. On the other hand, when the slider is stopped and the operation of the tab is finished, the locking pawl body is energized by the plate spring member and the locking pawl portion is advanced into the element guide passage before being engaged with fastener elements and therefore, the slider can be held at the stop position with stability.

In Japanese Patent Application Laid-Open Publication No. 2004-41440 (Patent Document 3), on the other hand, a slider fastener having a function to produce a sound when a slider is made to slide along an element row is disclosed.

The slide fastener described in Patent Document 3 includes left and right first and second fastener stringers including the element row and the slider that can be slid along the element row. All fastener elements constituting the element row have a protrusion disposed on the upper surface of the element and the protrusion provided on each fastener element is configured in such a way that the slider is not prevented from sliding or a human body is not damaged. Further, the slider has a sound production chamber including a pawl that produces a sound by being brought into contact with the protrusion provided on the fastener element.

In a slide fastener of Patent Document 3 configured as described above, when the slider is made to slide along the element row, a sound can be produced by the sound production chamber of the slider by the pawl of the slider being brought into contact with the protrusion of a fastener element and repelled. Accordingly, for example, by attaching a slide fastener of Patent Document 3 to an opening of a bag, a timbre can be played every time the opening is opened/closed, which makes it easier to notice pickpocketing or theft and increases crime prevention.

PRIOR ART DOCUMENT

Patent Document

Patent Document 1: Japanese Patent Application Laid-Open Publication No. 2009-95425

Patent Document 2: Japanese Patent Application Laid-Open Publication No. 2009-95370

Patent Document 3: Japanese Patent Application Laid-Open Publication No. 2004-41440

DISCLOSURE OF THE INVENTION

Problems to be Solved by the Invention

When, for example, a slide fastener is used in clothes or the like, a slider that opens/closes an element row may be desired to be stopped at a desired position of the element row to hold the stop position of the slider. However, according to the slide fastener 20 described in Patent Document 1, a free slider not equipped with a stopping mechanism like a locking pawl body is used as the first and second sliders 22*a*, 22*b* and thus, these first and second sliders 22*a*, 22*b* cannot basically be stopped at a desired position of the element row 24.

Even if the first and second sliders 22*a*, 22*b* are stopped at a position halfway through the element row 24, when the slide fastener 20 is subject to vibration or the like, each slider is likely to fall along the element row 24 due to the self-weight of each slider to freely open/close the slide fastener 20 against the will of the user. In addition, when the left and right fastener stringers 21 are pulled like separating the fastener stringers, the slider is subject to a stress (horizontal pulling force) from the fastener elements 24*a* via the left and right flange portions and may slide against the will of the user.

A slide fastener described in Patent Document 3 can produce a sound when the slider slides by using a protrusion disposed on a fastener element. However, the slide fastener described in Patent Document 3 is provided with protrusions on the element upper surface of all fastener elements and therefore, the slider increases sliding resistance when the slider is made to slide along the element row, posing a problem of decreasing operability of the slider.

On the other hand, a slider according to Patent Document 2 includes, as described above, a stopping mechanism with a locking pawl body capable of engaging with fastener elements and thus, by using, for example, the slider according to Patent Document 2 as the first and second sliders in Patent Document 1, the slider can be made to stop at a desired position of the element row.

However, in the case of the slider comprising such a locking pawl body, it is practically impossible for the user to open by pulling apart the fastener stringers while a locking pawl portion of the locking pawl body is engaged with a fastener element. In addition, when the slider is forcibly made to slide by some impetus like when the first and second fastener stringers left and right are instantaneously pulled hard in a separating direction, the locking pawl body and fastener elements are more likely to be damaged, which is one of the causes of a slide fastener failure.

The invention is made in view of the above conventional problems and a concrete object of the invention is to provide a slide fastener in which a slider can be stopped at any position with respect to an element row and which can be opened without damaging the slider and fastener elements by applying a force in a direction in which left and right fastener stringers are separated from each other when the slide fastener should be opened quickly according to the intention of the user and a slider used in the slide fastener.

Means for Solving the Problems

To achieve the above object, a slide fastener provided by the invention is a slide fastener comprising as a basic configuration a pair of first and second stringers on a left and right in which an element row is disposed on opposed tape side edges of first and second fastener tapes and a slider that can slide along the element row, the element row constituted of a plurality of fastener elements attached to the tape side edges at predetermined intervals and the slider including upper and lower blades, a connecting post connecting the upper and lower blades, and a flange portion disposed on left and right side edges of the upper and lower blades, wherein at least one stopping element including a resistance portion capable of making the slider stop and capable of locking the slider by contacting an inner surface of the slider, the stopping element includes a base fixed to the tape side edge of one of the first and second fastener tapes, a neck extending outwards beyond the tape side edge and having a shape constricted in a tape length direction, and a coupling head disposed on a tip side of the neck and having a substantially oblong shape and a shoulder extending from a front and a back of the neck in the tape length direction from a center portion of the neck in an up and down direction, and a dimension in a tape front and rear direction of the stopping element including the resistance portion is larger than a dimension between the upper and lower blades of the slider, or a chain width when the element rows are coupled across the stopping element including the resistance portion is larger than a minimum interval between the left and right flange portions of the slider, wherein when the left and right element rows are coupled and the stopping element, including the resistance portion is within the slider, the slider stops.

In this case, it is particularly preferable that the resistance portion be configured by at least one protuberance oriented in the tape front and rear direction of the stopping element and rising on at least one of a first surface and a second surface.

Further, in the slide fastener according to the invention, it is preferable that a portion with the largest dimension in the tape front and rear direction of the stopping element is disposed above a core thread portion of the first or second fastener tape.

Further, in the slide fastener according to the invention, it is preferable that a tape groove allowing the first and second fastener tapes to be inserted through is disposed on left and right side edges of the slider, the stopping element has a fin portion that is inserted through the tape groove of the slider, and the resistance portion is configured so that a dimension in a tape front and rear direction of the fin portion is larger than a groove width of the tape groove.

Further, in the slide fastener according to the invention, it is preferable that the stopping element includes a projection portion projecting in a tape width direction on a wall surface on a tape inner side and the resistance portion is configured by setting a projection dimension of the projection portion in such a way that a chain width when the left and right element rows are coupled becomes larger than a minimum interval between the left and right flange portions of the slider.

Also in the invention, it is preferable that at least one of the stopping element and the slider is configured to be elastically deformable in the tape front and rear direction or the tape width direction.

Further, it is preferable that the resistance portion has an inclined plane inclined in a tape length direction or a curved surface curved in the tape length direction.

Also in the invention, it is preferable that the two stopping elements or more are disposed consecutively on the element row in the tape length direction.

Further, it is preferable that the stopping element is disposed on one or both of the element rows of the first and second fastener stringers.

Further, in the invention, it is preferable that the stopping element is disposed in a region within 20% of a length dimension of the whole element row from an opening side end of the element row. Also, it is preferable that a separable bottom end stop is disposed on the first and second fastener stringers and the stopping element is disposed on the element row on a side on which a box pin of the separable bottom end stop is disposed.

In the slide fastener according to the invention, it is preferable that the slider includes a locking portion provided integrally with at least one of the upper and lower blades to maintain an immobilized state of the slider by interfering with the stopping element and the locking portion is configured to be elastically deformable in the tape front and rear direction.

In this case, it is preferable that the locking portion includes a projecting portion projecting toward an inner side in the tape front and rear direction from a main inner wall surface of the upper blade or the main inner wall surface of the lower blade and particularly, a pair of slits cut from a posterior orifice side end or a shoulder side end is disposed on at least one of the upper and lower blades, and the projecting portion is disposed at a tip of an elastic piece portion is disposed between the slits.

Further, in the invention, it is preferable that a groove portion that avoids interference with the resistance portion is disposed on at least one of the upper and lower blades.

Next, a slider provided by the invention is a slider for a slide fastener comprising as a basic configuration upper and lower blades, a connecting post connecting the upper and lower blades, and a flange portion disposed on left and right side edges of at least one of the upper and lower blades includes a locking portion provided integrally with at least one of the upper and lower blades to maintain an immobilized state of the slider by interfering with fastener elements of the slide fastener, wherein the locking portion is configured to be elastically deformable in a tape front and rear direction.

In such a slider according to the invention, it is preferable that the locking portion includes a projecting portion projecting toward an inner side in an up and down direction from a main inner wall surface of the upper blade or the main inner wall surface of the lower blade and particularly, a pair of slits cut from a posterior orifice side end or a shoulder side end are disposed on at least one of the upper and lower blades, and the projecting portion is disposed at a tip of an elastic piece portion is disposed between the slits.

Further, in the invention, it is preferable that a groove portion that avoids interference with fastener elements of the slide fastener is disposed on at least one of the upper and lower blades.

Effect of the Invention

In a slide fastener according to the invention, a stopping element including a resistance portion capable of locking a slider by being brought into contact with an inner surface of the slider to increase sliding resistance when the slider is sliding is disposed as at least one fastener element constituting an element row. Particularly in the invention, the stopping element is locally disposed at a position where the slider should be stopped on the element row.

According to a slide fastener of the invention having a simple locking mechanism using such a stopping element, even if the slider is not equipped with a locking pawl body as described in Patent Document 2, the slider can simply be stopped at any position where the stopping element is disposed on the element row and an immobilized state of the slider can be maintained by using the sliding resistance between the slider and the stopping element.

Thus, for example, when a slide fastener in the invention is attached to the front body of clothes, the stop position of the slider can easily be maintained by the stopping element of the element row and therefore, even if the slide fastener is subjected to vibration, the slider can be prevented from moving along the element row due to the self-weight. Accordingly, a malfunction like a case in which the slide fastener opens/closes freely regardless of the intention of the user can be prevented from occurring.

In addition, the immobilized state of the slider is maintained by large sliding resistance between an inner surface of the slider and fastener elements. Thus, for example, by operating the slider with an appropriate force greater than the sliding resistance to the stopping element so that the first and second fastener stringers on the left and right are separated, the slider can ride over the resistance portion of the stopping element to enable the slider to slide along the element row. In addition, also for example, by applying forces to the left and right fastener stringers in directions so that the fastener stringers are separated from each other to cause the slider to slide following the intention of the user, the slider can slide by riding over the resistance portion of the stopping element.

Therefore, in the invention, a situation in which a slider is forced to slide while a portion of the slider is engaged with fastener elements as described in, for example, Patent Document 2, does not arise and therefore, the slider and fastener elements are less likely to be damaged and, as a result, the product life of a slide fastener can be extended by preventing failures of the slide fastener.

Particularly in the invention, a stopping element can locally be provided at any position of an element row and thus, a stopping effect of a slider can be obtained by arranging the stopping element only at a position where the slider should be stopped on the element row and the sliding resistance does not increase over the entire element row and therefore, degradation of operability of the slider can also be inhibited. Incidentally, in the invention, the inner surface of the slider with which the stopping element comes into contact is an inner wall surface of upper and lower blades, an inner wall surface of a flange portion, or a projecting surface (tip surface) of the flange portion in the slider.

In such a slide fastener of the invention, the resistance portion is configured so that the dimension in a tape front and rear direction of the stopping element becomes larger than the interval between the upper and lower blades of the slider and particularly configured by at least one protuberance disposed to rise on a first surface (upper surface), a second surface (undersurface) or both of the first surface and the second surface oriented in the tape front and rear direction of the stopping element.

Accordingly, when the stopping element is inserted into an element guide passage of the slider, the sliding resistance of the slider can be increased by reliably causing the resistance portion of the stopping element to come into contact with at least one of the upper and lower blades of the slider. It is preferable to provide a plurality of protuberances for one stopping element. If one stopping element has the plurality of protuberances, the sliding resistance of the slider to the stopping element can be increased with stability.

Also, in a slide fastener in the invention, a portion with the largest dimension in the tape front and rear direction of the stopping element is disposed above a core thread portion of a first or second fastener tape. Accordingly, when, for example, the slider is made to slide with an appropriate force, the slider can easily ride over the resistance portion of the stopping element by deforming the core thread portion of the fastener tape so that the stopping element can pass through the element guide passage of the slider.

Further, in a slide fastener in the invention, a tape groove allowing the first and second fastener tapes to be inserted through is disposed on left and right side edges of the slider and the stopping element has a fin portion that is inserted through the tape groove of the slider. In addition, the resistance portion is configured so that the dimension in the tape front and rear direction of the fin portion of the fastener element becomes larger than a groove width of the tape groove of the slider. Accordingly, when the stopping element is inserted into the element guide passage of the slider, the sliding resistance of the slider can be increased by reliably causing the resistance portion of the stopping element to come into contact with a flange portion disposed on the slider.

Further, in a slide fastener in the invention, the stopping element includes a projection portion projecting in a tape width direction on a wall surface on a tape inner side and the resistance portion of the stopping element is configured by setting a projection dimension of the projection portion in such away that a chain width of the left and right element rows becomes larger than a minimum interval between the left and right flange portions of the slider. Also in this case, when the stopping element is inserted into the element guide passage of the slider, the sliding resistance of the slider can be increased by reliably causing the resistance portion of the stopping element to come into contact with the flange portion disposed on the slider.

In the invention, the chain width of the element row is a dimension between the position of a left side edge of a left-side fastener element and the position of a right side edge of a right-side fastener element in the tape width direction when the left and right element rows are coupled.

Also, in a slide fastener in the invention, at least one of the stopping element and the slider is configured to be elastically deformable in the tape front and rear direction or the tape width direction. Accordingly, when, for example, the slider is made to slide with an appropriate force, at least one of the stopping element and the slider can be deformed so that the stopping element can pass through the element guide passage of the slider.

Further, in the invention, the resistance portion has an inclined plane inclined in a tape length direction or a curved surface curved in the tape length direction. Accordingly, when the stopping element is passed through the element guide passage of the slider, the upper and lower blades of the slider can be guided by the inclined plane or the curved surface to assist the slider in riding over the resistance portion of the stopping element.

Also in the invention, the two stopping elements or more are disposed consecutively on the element row in the tape length direction. Accordingly, the slider can be stopped more effectively by the two stopping elements or more disposed next to each other and the immobilized state of the slider can be maintained with stability.

Further, in the invention, the slider can be stopped by the stopping element regardless of whether the stopping element is disposed on one element row or both element rows of the first and second fastener stringers.

Further, in the invention, a separable bottom end stop is disposed on the first and second fastener stringers and the stopping element is disposed on the element row on a side on which a box pin of the separable bottom end stop is disposed. Accordingly, even if the first and second fastener stringers are subjected to treatment such as washing while being separated from each other, the slider can effectively be prevented from sliding on the element row on the box pin side by the stopping element.

Also, in a slide fastener in the invention, the stopping element is disposed in a region within 20% of a length dimension of the whole element row from an opening side end of the element row. Accordingly, for example, when the slide fastener in the invention is attached to the front body of clothes or the like, the stopping element can effectively be arranged in a region where the slider is stopped with high frequency so that the slider can be stopped in the region with stability. The opening side end of the element row is a slider sliding end in a direction in which the slider is made to slide to close the slide fastener.

Further, in a slide fastener in the invention, the slider includes a locking portion provided integrally with at least one of the upper and lower blades to maintain an immobilized state of the slider by interfering with the stopping element and the locking portion is configured to be elastically deformable in the tape front and rear direction.

With such a locking portion disposed on the slider, the slider resistance between the stopping element and the locking portion of the slider can further be increased so that the slider can be stopped at a position where the stopping element is disposed more effectively and also the immobilized state of the slider can be maintained with more stability. In addition, the locking portion is configured to be elastically deformable in the tape front and rear direction and therefore, when, for example, the slider is made to slide with an appropriate force, the locking portion can be deformed, thereby enabling the slider to slide by riding over the stopping element.

In this case, the locking portion includes a projecting portion projecting toward an inner side in the tape front and rear direction from a main inner wall surface of the upper blade or the main inner wall surface of the lower blade. Accordingly, the locking portion can be brought into contact with the resistance portion of the stopping element more reliably. Particularly, by disposing a pair of slits cut from a posterior orifice side end or a shoulder side end on at least one of the upper and lower blades and the projecting portion at a tip of an elastic piece portion sandwiched between the slits, the lock portion can be configured in a simple structure to be reliably elastically deformable in the tape front and rear direction.

Further, in the invention, a groove portion that avoids interference with the resistance portion is disposed on at least one of the upper and lower blades. Accordingly, other portions of the slider than the locking portion can avoid excessive contact with the resistance portion of the stopping element and thus, the sliding resistance between the inner surface of the slider and the resistance portion of the stopping element can be inhibited from increasing. Therefore, a malfunction such as being unable for the slider to ride over the resistance portion of the stopping element can be prevented and also abrasion of the slider and stopping element is suppressed to extend the product life of the slide fastener.

Next, a slide fastener provided by the invention includes a locking portion provided integrally with at least one of the upper and lower blades to maintain the immobilized state of the slider by interfering with the fastener element and the locking portion is configured to be elastically deformable in the tape front and rear direction.

With such a locking portion disposed in a slider, the sliding resistance can be increased by bringing the locking portion of the slider into contact with fastener elements (for example, the stopping element) when the slider slides. Accordingly, the slider can be stopped at a position where fastener elements with which the locking portion comes into contact are disposed more effectively and also the immobilized state of the slider can be maintained with more stability.

Moreover, the locking portion is configured to be elastically deformable in the tape front and rear direction and thus, when, for example, the slider is made to slide with an appropriate force, the locking portion can be deformed. Therefore, even if the locking portion comes into contact with a fastener element, the locking portion can ride over the fastener element so that the slider can be made to slide along the element row.

In a slider in the invention described above, the locking portion includes a projecting portion projecting toward an inner side in an up and down direction from a main inner wall surface of the upper blade or the main inner wall surface of the lower blade. Accordingly, the locking portion can be brought into contact with fastener elements more reliably. Particularly, by disposing a pair of slits cut from a posterior orifice side end or a shoulder side end on at least one of the upper and lower blades and the projecting portion at a tip of an elastic piece portion sandwiched between the slits, the lock portion can be configured in a simple structure to be reliably elastically deformable in the tape front and rear direction.

Further, in a slider in the invention, a groove portion that avoids interference with fastener elements of a slide fastener is disposed on at least one of the upper and lower blades. Accordingly, other portions of the slider than the locking portion can avoid excessive contact with fastener elements and thus, the sliding resistance between the inner surface of the slider and fastener elements can be inhibited from increasing. Therefore, a malfunction such as being unable for the slider to slide can be prevented and also abrasion of the slider and fastener elements is suppressed to extend the product life of the slide fastener.

MODE(S) FOR CARRYING OUT THE INVENTION

Hereinafter, preferred embodiments of the invention will be described in detail by citing examples and referring to drawings.

First Embodiment

Figure 1:
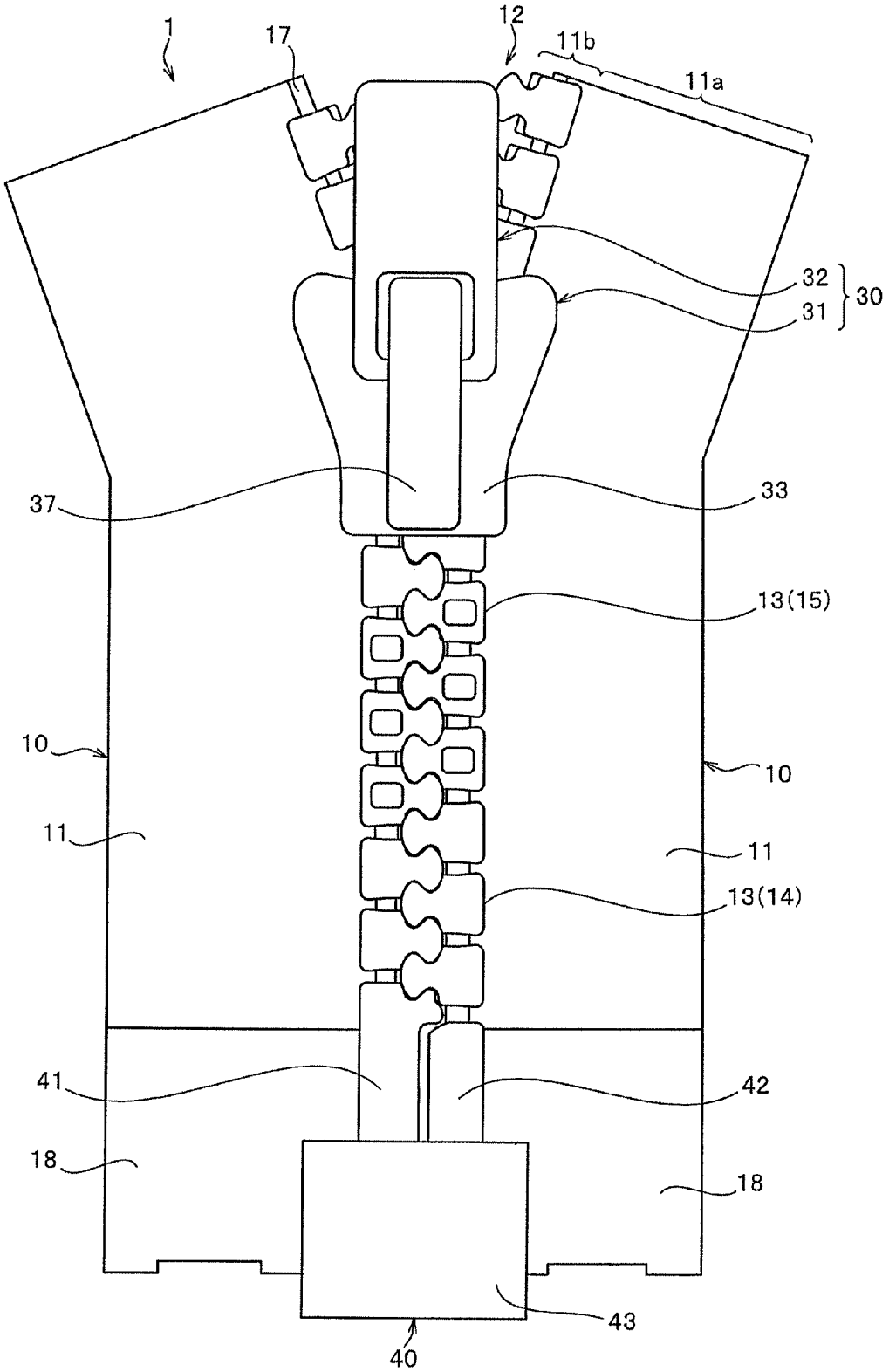
FIG. 1 is a front view showing a slide fastener according to a first embodiment of the invention.
Figure 2:
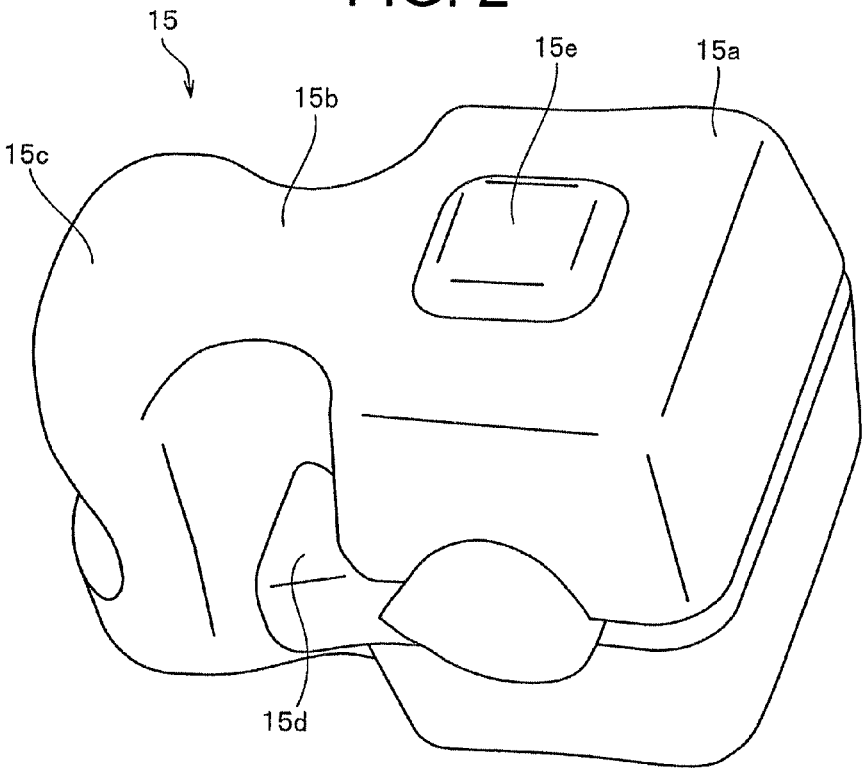
FIG. 2 is a perspective view showing a stopping element disposed on the slide fastener.
Figure 3:
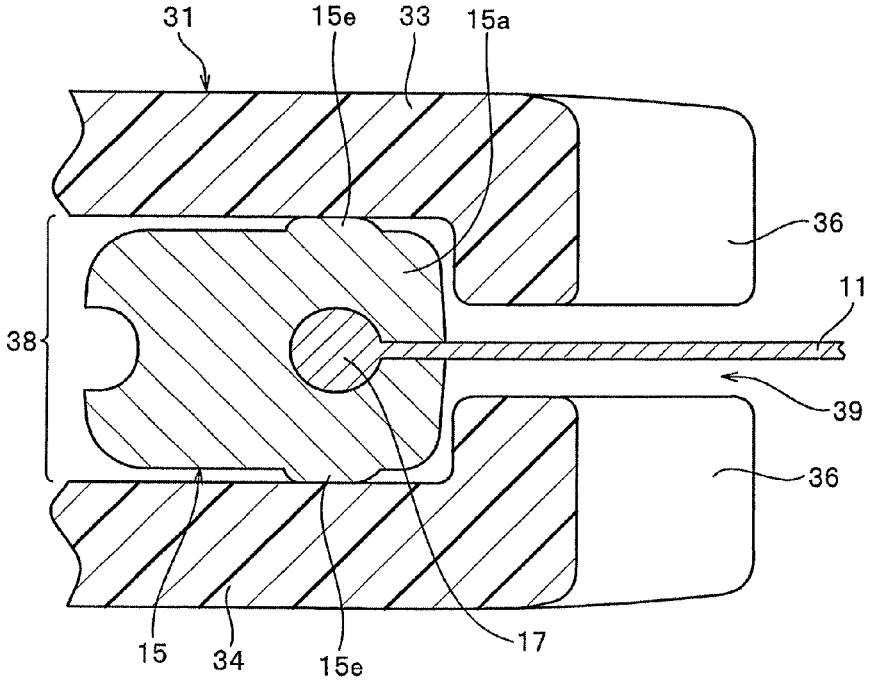
FIG. 3 is a sectional view showing the relationship between the stopping element and a slider in the slide fastener.

FIG. 1 is a front view showing a slide fastener according to a first embodiment and FIG. 2 is a perspective view showing a stopping element disposed on the slide fastener. FIG. 3 is a sectional view showing the relationship between the stopping element and a slider in the slide fastener.

In the description that follows, the front and back direction refers to a length direction of a fastener tape in the slide fastener and in particular, a direction in which the slider is made to slide toward a stop so as to couple left and right element rows is the front and a direction in which the slider is made to slide toward a separable bottom end stop to separate the left and right element rows is the back.

The left and right direction refers to a tape width direction of a fastener tape and the left side and the right side when the slide fastener is viewed from the front side as shown in FIG. 1 are the left and the right respectively. The up and down direction refers to a tape front and rear direction perpendicular to the tape surface of the fastener tape and the side of the tape surface of the fastener tape on which the slider tab is disposed is the upper side and the opposite side is the lower side.

A slide fastener 1 according to the present embodiment includes a pair of left and right fastener stringers 10 including element rows 12 in opposed tape side edges of fastener tapes 11, a slider 30 slidably disposed along the element rows 12, a separable bottom end stop 40 disposed at a back end of the fastener stringers 10, and stops (not shown) fixed to tape side edges of the first and second fastener tapes 11 continuously from the upper end of the element rows 12.

In this case, the fastener stringer 10 and the fastener tape 11 disposed on the left side constitute the first fastener stringer and the first fastener tape of the invention and the fastener stringer 10 and the fastener tape 11 disposed on the right side constitute the second fastener stringer and the second fastener tape of the invention.

The left and right fastener stringers 10 in the present embodiment each include the fastener tape 11 and a plurality of fastener elements 13 disposed on the tape side edge and made of synthetic resin. Each of the left and right fastener tapes 11 is woven or knit in a thin belt-like shape and includes a tape main body portion 11*a* sewn on products to which fastener is attached (for example, clothes) and an element attaching portion 11*b* (tape side edge) to which the fastener element 13 is attached. In addition, a core thread portion 17 is disposed on a tape side edge on the side of the element attaching portion 11*b* of the fastener tape 11.

In the left and right fastener tapes 11, the plurality of fastener elements 13 is provided in a row at regular intervals along the tape length direction by injection molding in the element attaching portion 11*b* including the core thread portion 17 and the plurality of fastener elements 13 constitutes the element row 12. In addition, a reinforcing film 18 made of synthetic resin is affixed to the front and rear surfaces at a lower end of the left and right fastener tapes 11.

Incidentally, the material of the fastener element 13 is not limited in the invention and, for example, synthetic resin such as polyacetal, polypropylene, polybutylene terephthalate, nylon, polycarbonate may be used or metal such as a copper alloy may be used. In the present embodiment, the fastener element 13 is formed elastically deformably, particularly elastically deformably in the up and down direction by injection molding of synthetic resin into a predetermined shape.

The fastener elements 13 constituting the element row 12 in the present embodiment contain normal elements 14 having a general shape and stopping elements 15 equipped with a resistance portion increasing sliding resistance of the slider 30. In this case, the three stopping elements 15 are consecutively disposed on each of the left and right element rows 12 and the normal elements 14 are disposed across the stopping elements 15 in the length direction.

Particularly, the three stopping elements 15 disposed on the element row 12 on the left side and the three stopping elements 15 disposed on the element row 12 on the right side are disposed in corresponding regions in the tape length direction so as to be able to mutually couple and these stopping elements 15 are arranged closer to the separable bottom end stop 40 in the length direction of the element row 12.

The normal element 14 includes abase fixed to the element attaching portion 11*b* of the fastener tape 11, a neck extending to the outside of the tape from the base and having a shape constricted in the tape length direction, a coupling head disposed on the tip side of the neck and having a substantially oblong shape, and a shoulder extending in the front and back direction from the neck in a substantial center portion in the up and down direction and is configured so that, when the left and the right element rows 12 are coupled, the coupling head of the fastener element 13 of the coupling party is engaged between the necks of the adjacent fastener elements 13.

The normal element 14 may also be provided with a fin portion extending to the inside of the tape from the base to increase fixing strength to the fastener tape 11. When the fin portion is provided, the maximum value of the thickness dimension in the up and down direction of the fin portion is set smaller than a groove width of a tape groove 39 described later of the slider 30.

In the present embodiment, the maximum value of the thickness dimension in the up and down direction between the upper surface and the undersurface of the normal element 14 is set smaller than an interval between inner wall surfaces (particularly, the minimum value of the interval) of upper and lower blades 33, 34 described later of the slider 30. Accordingly, when the normal element 14 passes through an element guide passage 38 of the slider 30, the normal element 14 can be prevented from being caught by the slider 30 and also sliding resistance generated. when the slider 30 slides is reduced to be smaller.

On the other hand, the stopping element 15 is configured in a form in which a protuberance 15*e* to serve as a resistance portion is provided on the upper surface and the undersurface of the above normal element 14 and all the stopping elements 15 have the same shape. More specifically, as shown in FIG. 2, the stopping element 15 includes a base 15*a* fixed to the element attaching portion 11*b* of the fastener tape 11, a neck 15*b* extending to the outside of the tape from the base 15*a* and having a shape constricted in the tape length direction, a coupling head 15*c* disposed on the tip side of the neck 15*b* and having a substantially oblong shape, a shoulder 15*d* extending in the front and back direction from the neck 15*b* in a substantial center portion in the up and down direction, and the protuberance (resistance portion) 15*e* rising from the upper surface and the undersurface of the base 15*a*.

In this case, each of the upper and lower protuberances 15*e* is provided in a substantial center portion in the front and back direction and the left and right direction of the base 15*a* and is disposed above the core thread portion 17 of the fastener tape 11 when the slide fastener 1 is viewed from the front side or the rear side.

In addition, the center region of the protuberance 15*e* is disposed substantially in parallel with the tape surface of the fastener tape 11 and the outside surface extending from a center region edge of the protuberance 15*e* to front and back edges and left and right edges of the protuberance 15*e* (that is, a boundary portion between the protuberance 15*e* and the base 15*a*) is formed as a curved surface curved in such a way that the thickness dimension in the up and down direction of the protuberance 15*e* is gradually reduced toward each edge.

With such a curved surface disposed on the protuberance 15*e*, when, for example, the stopping element 15 is passed through the element guide passage 38 of the slider 30, the upper and lower blades 33, 34 of the slider 30 are guided by the curved surface to be able to assist the slider 30 in riding over the protuberance 15*e* of the stopping element 15. In addition, with the peripheral surface of the protuberance 15*e* being curved, the appearance of the stopping element 15 is improved and appearance quality of the slide fastener 1 is improved.

In the stopping element 15, the maximum value of the thickness dimension of the stopping element 15 in the up and down direction from the protuberance 15*e* disposed on the upper surface of the base 15*a* to the protuberance 15*e* disposed on the undersurface of the base 15*a* is set slightly larger than the interval between inner wall surfaces (particularly, the minimum value of the interval) of the upper and lower blades 33, 34 described later of the slider 30.

Accordingly, when the stopping element 15 advances into the element guide passage 38 of the slider 30, the upper and lower protuberances (resistance portions) 15*e* of the stopping element 15 reliably come into contact with the upper and lower blades 33, 34 of the slider 30 and the sliding resistance of the slider 30 can significantly be increased when compared with a case in which the normal element 14 advances into the element guide passage 38 of the slider 30.

Incidentally, the stopping element 15 is configured to increase the sliding resistance of the slider 30 by the resistance portion in the invention and if, for example, although the protuberances are disposed on the upper surface and the undersurface of the base in the fastener element, the maximum value of the thickness dimension of a fastener element in the up and down direction from the protuberance on the upper surface side to the protuberance on the undersurface side is set smaller than the interval between the inner wall surfaces of the upper and lower blades 33, 34 of the slider 30 and depending on the protuberance, when the sliding resistance of the slider 30 cannot be increased, the protuberances are not included in the resistance portion.

The stopping element 15 in the present embodiment is configured in a form in which the upper and lower protuberances 15*e* are integrally formed as shown in FIG. 2 by, as described above, injection molding of synthetic resin onto the element attaching portion 11*b* of the fastener tape 11.

In the invention, however, the stopping element 15 can be formed by forming the normal element 14 and then providing the protuberance 15*e* on the base of the normal element 14. In this case, the base 15*a* and the protuberance 15*e* of the stopping element 15 may be formed of the same material or different materials. In addition, the protuberance 15*e* of the stopping element 15 may be provided on only one of the upper surface and the undersurface of the base 15*a*.

The slider 30 in the present embodiment is configured substantially in the same manner as a so-called free slider that has generally been used.

More specifically, the slider 30 includes a slider body 31 and a tab 32 held rotatably on the slider body 31. The slider body 31 includes the upper and lower blades 33, 34, a connecting post 35 connecting front ends of the upper and lower blades 33, 34, left and right flange portions 36 extending from left and right side edges of the upper and lower blades 33, 34 in a direction closer to each other, and a tab mounting post 37 provided upright in a gate shape on the upper surface of the upper blade 33.

Left and right shoulders are formed across the connecting post 35 at a front end of the slider body 31 and a posterior orifice is formed at a back end of the slider body 31. In addition, the element guide passage 38 in a substantially Y shape communicating the left and right shoulders and the posterior orifice is formed between the upper and lower blades 33, 34. Further, the tape groove 39 through which the left and right fastener tapes 11 can be inserted is formed between the left and right upper flange portions 36 provided vertically downward from the upper blade 33 and the left and right lower flange portions 36 provided vertically upward from the lower blade 34.

Incidentally, the material of the slider 30 is not particularly limited in the invention and, for example, synthetic resin such as polyamide, polypropylene, and polyacetal or metal such as an aluminum alloy and zinc alloy can be used. In the present embodiment, the slider body 31 of the slider 30 is formed of synthetic resin and at least the upper and lower blades 33, 34 is configured to be elastically deformable in the up and down direction with the connecting post 35 set as a starting point.

The separable bottom end stop 40 and the stop (not shown) in the present embodiment are also configured substantially in the same manner as those that have generally been used.

That is, the separable bottom end stop 40 includes an insert pin 41 fixed to the fastener tape 11 continuously from the back end of the element row 12 on the left side, a box pin 42 fixed to the fastener tape 11 continuously from the back end of the element row 12 on the right side, and a box 43 integrally formed at a back end of the box pin 42 and the insert pin 41 is configured to be able to be inserted into the box 43. The stop is fixed to the left and right fastener tapes 11 continuously from the front end of the left and right element rows 12 so that the slider 30 should not drop from the front end of the element row 12.

Incidentally, the configuration of the separable bottom end stop 40 or the stop is not particularly limited in the invention and can arbitrarily be changed. For example, instead of the separable bottom end stop 40 in the present embodiment, for example, as described in Patent Document 1, a separable bottom end stop including two sliders, an insert pin, and a box pin and capable of separating left and right element rows from both end sides in the length direction may be provided. Also, as a stop in the present embodiment, for example, a stop equipped with a holding portion capable of holding the slider 30 at the stop position may be provided.

The slide fastener 1 in the present embodiment configured as described above can slide the slider 30 smoothly along the element row 12 and easily open/close the left and right element rows 12 by operating the slider 30 with an appropriate force greater than the sliding resistance generated between the slider 30 and the stopping element 15.

Particularly in the present embodiment, the stopping element 15 and the slider body 31 of the slider 30 are, as described above, configured to be elastically deformable. Thus, when the stopping element 15 advances into the element guide passage 38 of the slider 30 and the protuberance 15*e* of the stopping element 15 comes into contact with the inner surface of the slider 30 after the slider 30 being operated with an appropriate force, at least one of the stopping element 15 and the slider body 31 can be deformed.

Accordingly, a difference between the thickness dimension from the protuberance 15*e* disposed on the upper surface of the stopping element 15 to the protuberance 15*e* disposed on the undersurface of the stopping element 15 and the dimension between the inner wall surfaces of the upper and lower blades 33, 34 of the slider 30 can be absorbed by deformation of the stopping element 15 and/or the slider body 31, thereby allowing the stopping element 15 to be inserted into the element guide passage 38 of the slider 30 (in other words, the slider 30 can ride over the stopping element 15).

At least one of the stopping element 15 and the slider 30 needs to be configured to be elastically deformable in the invention so that the slider 30 can ride over the stopping element 15, but by configuring both the stopping element 15 and the slider 30 to be elastically deformable, the amount of elastic deformation of each of the stopping element 15 and the slider 30 can be reduced, which inhibits degradation of these members and leads to extension of the product life of the slide fastener 1.

Further, in the present embodiment, the protuberance 15*e* of the stopping element 15 is arranged above the core thread portion 17 of the fastener tape 11 and thus, the slider 30 can ride over the stopping element 15 by using also deformation of the core thread portion 17 while suppressing abrasion of the stopping element 15 and the slider 30 when the protuberance 15*e* of the stopping element 15 comes into contact with the inner surface of the slider 30.

On the other hand, when the slider 30 is stopped at a position where the stopping element 15 of the element row 12 is disposed, as shown in FIG. 3, large sliding resistance (friction) can be generated between the slider 30 and the stopping element 15 by bringing the inner wall surfaces of the upper and lower blades 33, 34 of the slider 30 and the protuberance 15*e* of the stopping element 15 into contact for locking. Therefore, the immobilized state of the slider 30 can easily be maintained by using the generated sliding resistance.

Further, when the slider 30 is stopped at a position of the element row 12 where the normal element 14 is disposed, because it is hard to generate resistance between the normal element 14 and the slider 30, the slider 30 may move along the element row 12 due to the self-weight when subjected to vibration or the like. In this case, however, in the slide fastener 1 in the present embodiment the slider 30 moving due to the self-weight can be stopped at a position of the stopping element 15 by using the sliding resistance generated between the slider 30 and the stopping element 15. Accordingly, a malfunction like a case in which the slide fastener 1 opens/closes freely regardless of the intention of the user can be prevented from occurring.

On the other hand, when the slider 30 is made to slide from a state in which the slider 30 is maintained by the stopping element 15, the slider 30 is operated with a force greater than the sliding resistance generated between the slider 30 and the stopping element 15 or a force greater than the sliding resistance generated between the slider 30 and the stopping element 15 is given to the slider 30 by applying forces to the left and right fastener stringers in directions so that the fastener stringers are separated from each other. Accordingly, the slider 30 can be made to ride over the resistance portion of the stopping element 15 and to slide smoothly along the element row 12 without damaging the slider 30 and the fastener element 13.

The slide fastener 1 according to the invention is not limited to the first embodiment described above and various modifications may be made as long as the configuration is substantially the same as that of the invention in which at least one stopping element including a resistance portion to a slider is disposed on an element row and the same operation effect is achieved.

For example, the element row 12 of the slide fastener 1 according to the first embodiment is constituted of a plurality of the independent fastener elements 13 molded on the fastener tape 11 by injection, but the element row may be constituted of continuous fastener elements produced by forming a mono-filament in a coiled shape or zigzag shape in the invention.

Figures 4A, 4B, 4C, 4D, 4E, 4F, 4G, 4H, 4I, 4J, 4K, 4L, 4M:
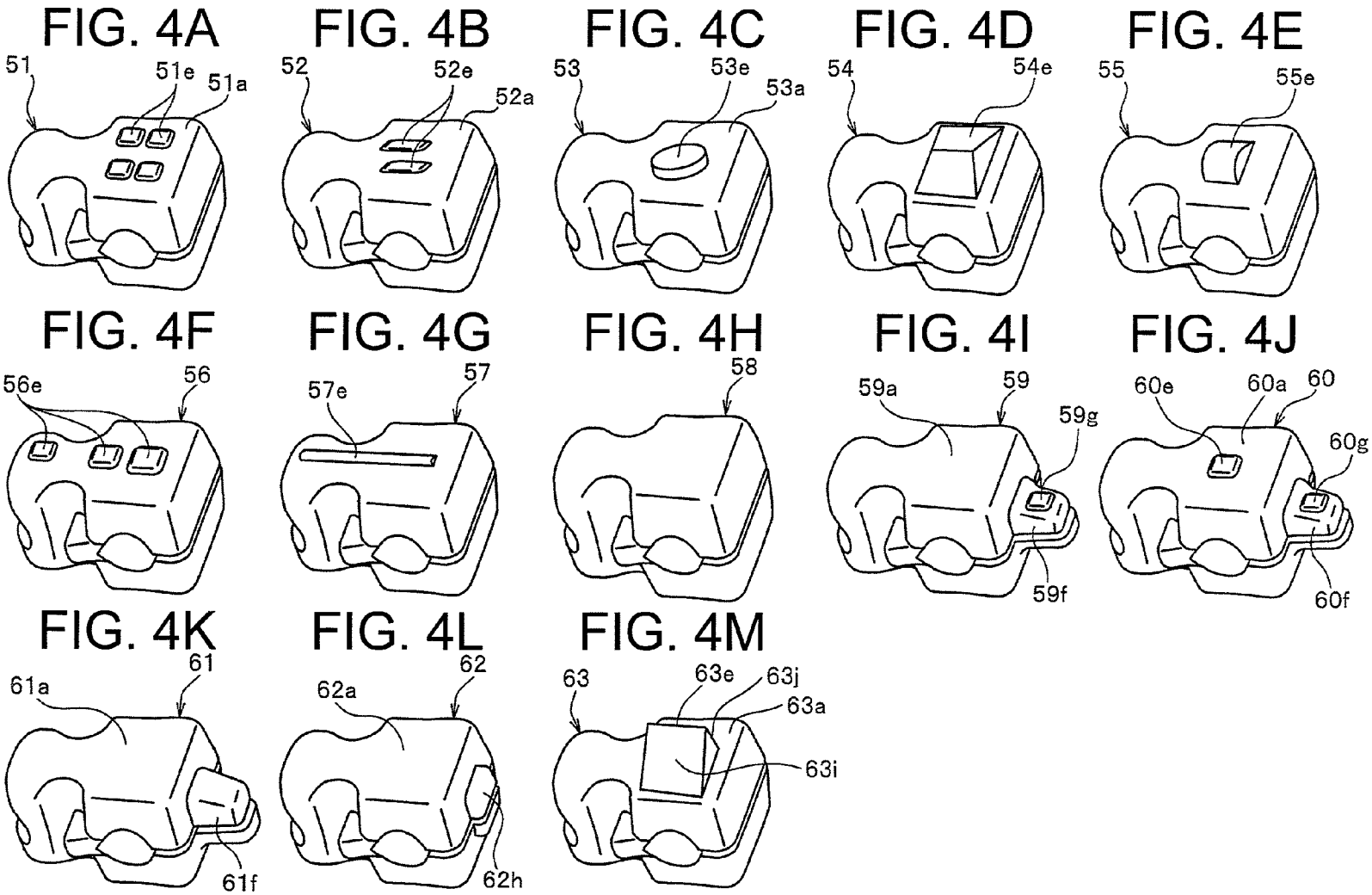
FIGS. 4(*a*) to 4(*m*) are perspective views showing modifications of the stopping element.

In addition, the stopping element is not limited to the one having the form shown in FIG. 2 and can arbitrarily change the form and the number of resistance portions and may be configured in other forms as shown, for example, in FIGS. 4(*a*) to 4(*m*). Hereinafter, the form of each stopping element shown in FIGS. 4(*a*) to 4(*m*) will briefly be described. These stopping elements are constituted by, like the first embodiment described above, injection molding of synthetic resin.

A stopping element 51 shown in FIG. 4(*a*) is configured by four protuberances (resistance portions) 51*e* being disposed in a tidy array on each of the upper surface and the undersurface of abase 51*a*. Excluding the configuration of the protuberance 51*e*, the stopping element 51 is configured in the same manner as the stopping element 15 in the first embodiment. That is, the stopping element 51 in FIG. 4(*a*) has a form in which the four protuberances 51*e* are provided on the upper surface and the undersurface of the normal element 14 in the first embodiment and these protuberances 51*e* are all provided so as to be disposed above the core thread portion 17 of the fastener tape 11.

In this case, the maximum value of the thickness dimension of the stopping element 51 in the up and down direction from the protuberance 51*e* disposed on the upper surface side to the protuberance 51*e* disposed on the undersurface side is set, like the first embodiment, larger than the interval between the inner wall surfaces of the upper and lower blades 33, 34 of the slider 30. Accordingly, when the stopping element 51 is inserted into the element guide passage 38 of the slider 30, the sliding resistance of the slider 30 can be increased by reliably bringing the protuberance 51*e* of the stopping element 51 into contact with the upper and lower blades 33, 34 of the slider 30. Incidentally, such an effect can also be similarly obtained from protuberances 52*e* to 57*e* of FIGS. 4(*b*) to 4(*g*) below.

A stopping element 52 shown in FIG. 4(*b*) is configured by the two protuberances (resistance portions) 52*e* formed in a long and narrow shape in the width direction being disposed on each of the upper surface and the undersurface of a base 52*a*.

A stopping element 53 shown in FIG. 4(*c*) is configured by the protuberance (resistance portion) 53*e* in a cylindrical shape being disposed on each of the upper surface and the undersurface of a base 53*a*.

The protuberance (resistance portion) 54*e* of a stopping element 54 shown in FIG. 4(*d*) is formed in a mountain shape in which the center portion is higher over substantially the entire stopping element 54 in the length direction and has an inclined plane inclined downward from a ridgeline portion to a front edge and a back edge of the protuberance 54*e*. With such an inclined plane disposed on the protuberance 54*e*, it can be made easier for the slider 30 to ride over the protuberance 54*e* of the stopping element 54.

The protuberance (resistance portion) 55*e* of a stopping element 55 shown in FIG. 4(*e*) is disposed in the center portion in the length direction of the stopping element 55 and has an outside surface (the upper surface or undersurface) curved in an arc shape. That is, the cut surface obtained by cutting the protuberance 55*e* in a direction perpendicular to the tape width direction is formed in a bow shape and it is thereby made easier for the slider 30 to ride over the protuberance 55*e*.

In a stopping element 56 shown in FIG. 4(*f*), the three protuberances (resistance portions) 56*e* are disposed in a row in the tape width direction on each of the upper surface and the undersurface of the stopping element 56 extending over the base, neck, and coupling head.

A stopping element 57 shown in FIG. 4(*g*) has an outside surface curved in an arc shape and has the protuberance 57*e* whose cut surface in a direction perpendicular to the tape width direction is formed in a bow shape is disposed along the tape width direction extending from the base to the coupling head.

A stopping element 58 shown in FIG. 4(*h*) is configured by, when compared with the normal element 14 in the first embodiment, making larger the thickness dimension in the up and down direction (tape front and rear direction) from the element upper surface to the element undersurface. In this case, the resistance portion that increases the sliding resistance of the slider 30 is configured by setting the maximum value of the thickness dimension in the stopping element 58 larger than the interval between the inner wall surfaces of the upper and lower blades 33, 34 of the slider 30.

A stopping element 59 shown in FIG. 4(*i*) has a structure in which a fin portion 59*f* extending from a base 59*a* toward the inner side of the tape and a protuberance 59*g* rising on the upper surface and the undersurface of the fin portion 59*f* are added to the normal element 14 in the first embodiment and the fin portion 59*f* of the stopping element 59 is configured to be inserted through the tape groove 39 of the slider 30.

In this case, the maximum value of the thickness dimension in the up and down direction from the protuberance 59*g* disposed on the upper surface side of the fin portion 59*f* to the protuberance 59*g* disposed on the undersurface side is set larger than the groove width of the tape groove 39 of the slider 30 and the fin portion 59*f* comprising the upper and lower protuberances 59*g* is configured as a resistance portion that increases the sliding resistance of the slider 30.

A stopping element 60 shown in FIG. 4(*j*) has a structure in which a protuberance 60*e* is added to the upper surface and the undersurface of abase 60*a* in the form of the stopping element 59 shown in FIG. 4(*i*). In this case, the protuberance 60*e* disposed on the base 60*a* and a fin portion 60*f* comprising a protuberance 60*g* are each configured as resistance portions to increase the sliding resistance of the slider 30.

A stopping element 61 shown in FIG. 4(*k*) has a fin portion 61*f* extending from a base 61*a* toward the inner side of the tape. In the stopping element 61, the resistance portion is configured by increasing the size of the fin portion 61*f* as a whole and setting the maximum value of the thickness dimension in the up and down direction (tape front and rear direction) from the upper surface to the undersurface of the fin portion 61*f* larger than the groove width of the tape groove 39 of the slider 30.

A stopping element 62 shown in FIG. 4(*l*) has a projection portion 62*h* projecting in the tape width direction from a base 62*a* toward the inner side of the tape. The projection height from the side face of a base 62*a* in the projection portion 62*h* is set with respect to the minimum interval between the left and right flange portions 36 at a posterior orifice side end of the slider 30.

Figure 5:
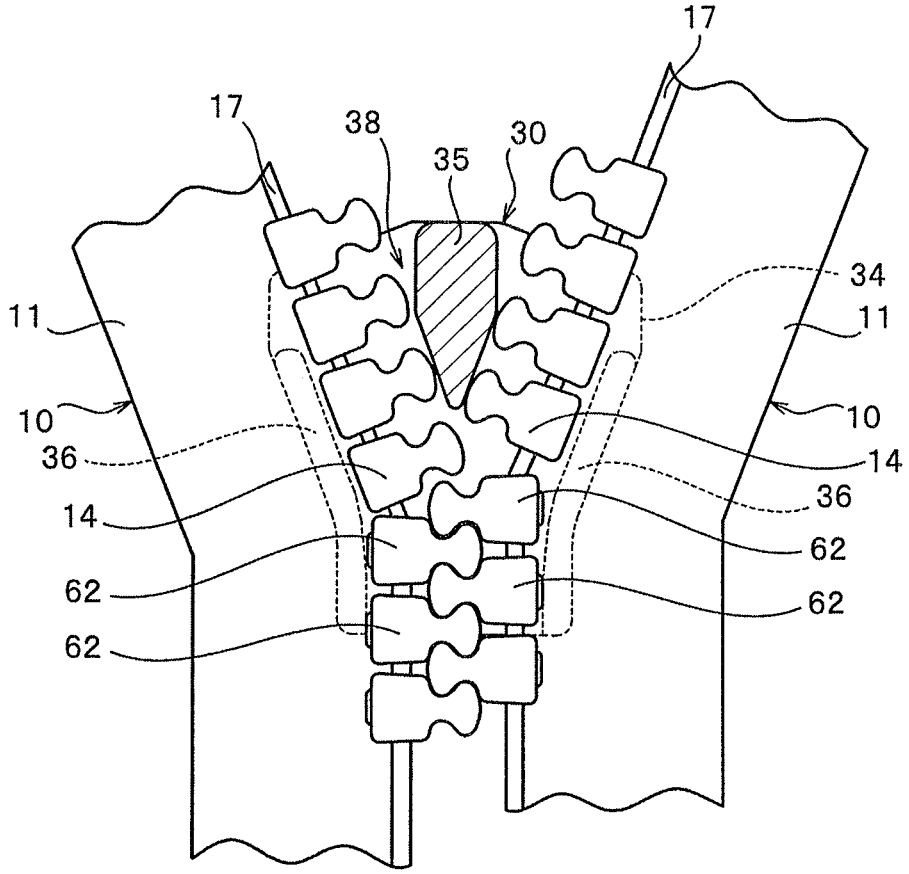
FIG. 5 is an explanatory view illustrating the relationship between the stopping element according to a modification and the slider.
Figure 6A:
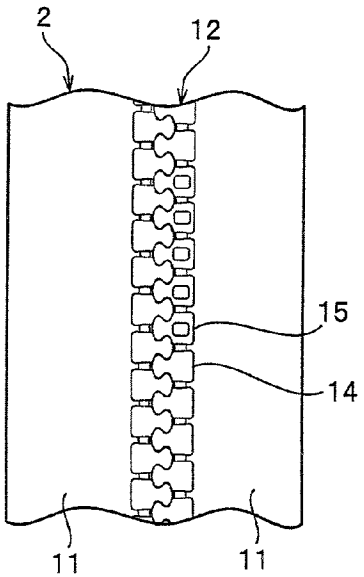
FIGS. 6*a* to 6*d* are front views showing the arrangement of the stopping elements according to the modifications.
Figure 6B:
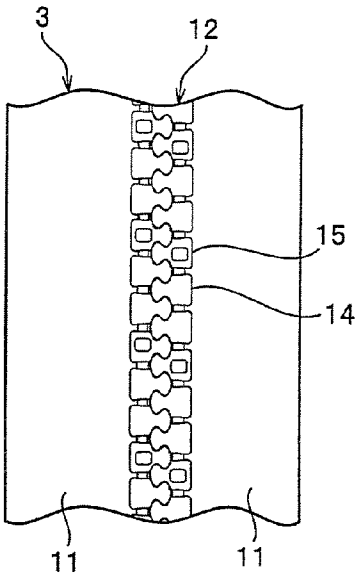
Figure 6C:
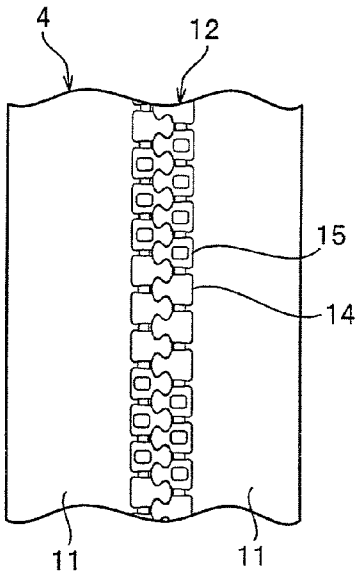
Figure 6D:
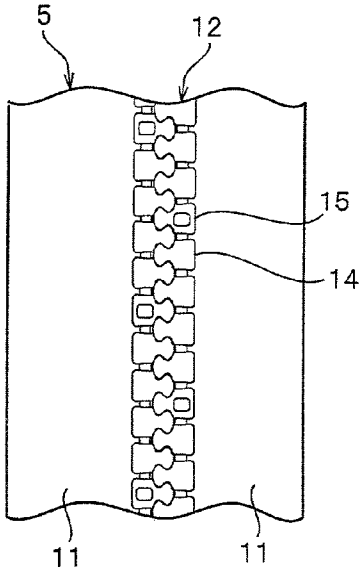

That is, in the stopping element 62, as shown in FIG. 5, the resistance portion that increases the sliding resistance of the slider 30 is configured by setting the projection height of the projection portion 62*h* in the stopping element 62 so that the chain width of the element row 12 at a position where the stopping element 62 is disposed when the left and right element rows 12 are coupled becomes larger than the minimum interval between the left and right flange portions 36 at a posterior orifice side end of the slider 30.

In this case, the sliding resistance of the slider 30 can be increased by the projection portion 62*h* of the stopping element 62 more effectively by arranging the stopping elements 62 so that the stopping elements 62 are coupled in the left and right element rows 12. In addition, it is preferable that the slider 30 is configured so that the left and right flange portions 36 are elastically deformable in the tape width direction and the slider 30 can thereby ride over the stopping element 62 when operated with an appropriate force.

A stopping element 63 shown in FIG. 4(*m*) has a form like being created by cutting off a front half portion of the protuberance 54*e* in the stopping element 54 shown in FIG. 4(*d*). That is, a protuberance 63*e* including a first inclined plane 63*i* that is inclined upward so that the thickness dimension of an element is gradually increased from the back end edge of a base 63*a* toward the front and a second inclined plane 63*j* that is inclined downward at an acute angle from the substantial center position in the length direction of the stopping element 63 toward the front is disposed on the upper surface and the undersurface of the base 63*a* in the stopping element 63 in FIG. 4(*m*) and the angle of inclination of the second inclined plane 63*j* with respect to the tape surface of the fastener tape 11 is set larger than the angle of inclination of the first inclined plane 63*i*. In this case, the cut surface perpendicular to the tape width direction of a protuberance 63*e* is formed in a triangular shape.

In the stopping element 63 configured as described above, when, for example, the first inclined plane 63*i* of the protuberance 63*e* is disposed on the element row 12 so as to be oriented toward the back side (the side of the separable bottom end stop 40), the stopping element 63 advances into the element guide passage 38 from the shoulder of the slider 30 when the slider 30 is made to slide in a direction (forward) in which the left and right element rows 12 are coupled.

At this point, the stopping element 63 enters the element guide passage 38 of the slider 30 from the side of the first inclined plane 63*i* of the protuberance 63*e* and therefore, an effect of assisting the slider 30 in riding over the protuberance 63*e* of the stopping element 63 smoothly by the upper and lower blades 33, 34 of the slider 30 being guided by the first inclined plane 63*i* whose angle of inclination is gentle is obtained.

When the slider 30 is made to slide in a direction (backward) in which the left and right element rows 12 are separated, on the other hand, the stopping element 63 advances into the element guide passage 38 from the posterior orifice of the slider 30. At this point, the stopping element 63 advances into the element guide passage 38 of the slider 30 from the side of the second inclined plane 63*j* of the protuberance 63*e* and therefore, an effect of making it easier to stop the slider 30 at the position of the stopping element 63 is obtained, even if it becomes difficult to obtain the assistance effect for the slider 30 like the first inclined plane 63*i* described above.

That is, the stopping element 63 in FIG. 4(*m*) can obtain different effects as described above depending on the direction in which the slider 30 is made to slide and, for example, with the slide fastener comprising the stopping element 63, the slide fastener can be configured in such a way that left and right element rows are difficult to be separated, while the element rows are coupled smoothly.

In addition, the position and number of stopping elements arranged in an element row of a slide fastener is not particularly limited in the invention and can, as shown in FIGS. 6(*a*) to 6(*d*), arbitrarily be changed according to necessity.

For example, like a slide fastener 2 shown in FIG. 6(*a*). the stopping element 15 may be arranged only on the element row 12 of one of the fastener stringers 10 and the slider 30 can also thereby be stopped simply by the stopping element 15 and the immobilized state of the slider 30 can be maintained with stability. In the slide fastener 2 shown in FIG. 6(*a*), the stopping element 15 is arranged at a position of the element row 12 where the slider 30 should be stopped.

In this case, it is preferable that the stopping element 15 is disposed on the element row 12 of the fastener stringer 10 on the side on which the box pin 42 is disposed. When, for example, the left and right fastener stringers 10 are pulled apart by the left and right element rows 12 as a whole being separated, the slider 30 is maintained on the element row 12 on the side on which the box pin 42 is disposed. Therefore, with the stopping element 15 disposed on the element row 12 on the side on which the box pin 42 is disposed, the effect of the stopping element 15 for the slider 30 described above can be obtained with stability even when the left and right fastener stringers 10 are pulled apart.

In a slide fastener 3 shown in FIG. 6(*b*), the stopping element 15 is disposed on every three fastener elements on each of the left and right element rows 12 and particularly, these stopping elements 15 are arranged so as to be coupled between the left and right element rows 12. In this case, the stopping element 15 may be disposed at predetermined intervals over the entire element row 12 in the length direction or at predetermined intervals over only a predetermined region of the element row 12 in the length direction.

In a slide fastener 4 shown in FIG. 6(*c*), a region (stop region) in which a plurality of the stopping elements 15 is consecutively arranged is provided at a plurality of locations of the element row 12. Also in this case, the stopping elements 15 are arranged so as to be coupled between the left and right element rows 12. The number of the stopping elements 15 arranged in a stop region may arbitrarily be changed.

Further, in a slide fastener 5 shown in FIG. 6(*d*), the stopping element 15 is disposed at predetermined intervals on the left and right element rows 12, but is arranged in such a way that the stopping elements 15 are not coupled between the left and right element rows 12. Particularly in the slide fastener 5 shown in FIG. 6(*d*), the stopping element 15 is arranged in a zigzag shape on the left and right at predetermined intervals on the left and right element rows 12.

Like the first embodiment described above, the slide fasteners 3 to 5 in which the stopping elements 15 shown in FIGS. 6(*b*) to 6(*d*) are arranged respectively can obtain the effect of the stopping element 15 for the slider 30 with stability.

When a slide fastener according to the invention is used in a front body of clothes like, for example, sportswear, it is preferable that the stopping element 15 is disposed in a region within 50% of the element row 12, particularly in a region within 20% from the position of the stop as the end of an opening side of the element row 12 in the length direction of the element row 12. Accordingly, the slider 30 can be stopped with stability by effectively arranging the stopping element 15 in a region in which the slider 30 is generally stopped with high frequency in the clothes.

Further in the invention, the configuration of a slider disposed on a slide fastener can arbitrarily be changed and, for example, sliders including locking portions 72, 82, 92 according to first to third modifications shown below may be used, instead of the free slider 30 according to the first embodiment.

The material of sliders according to the first to third modifications is not particularly limited, but it is preferable to mold slider bodies 71, 81, 91 in these sliders by using synthetic resin such as polyamide, polypropylene, and polyacetal to make, as will be described later, a portion of the slider bodies 71, 81, 91 elastically deformable.

Figure 7:
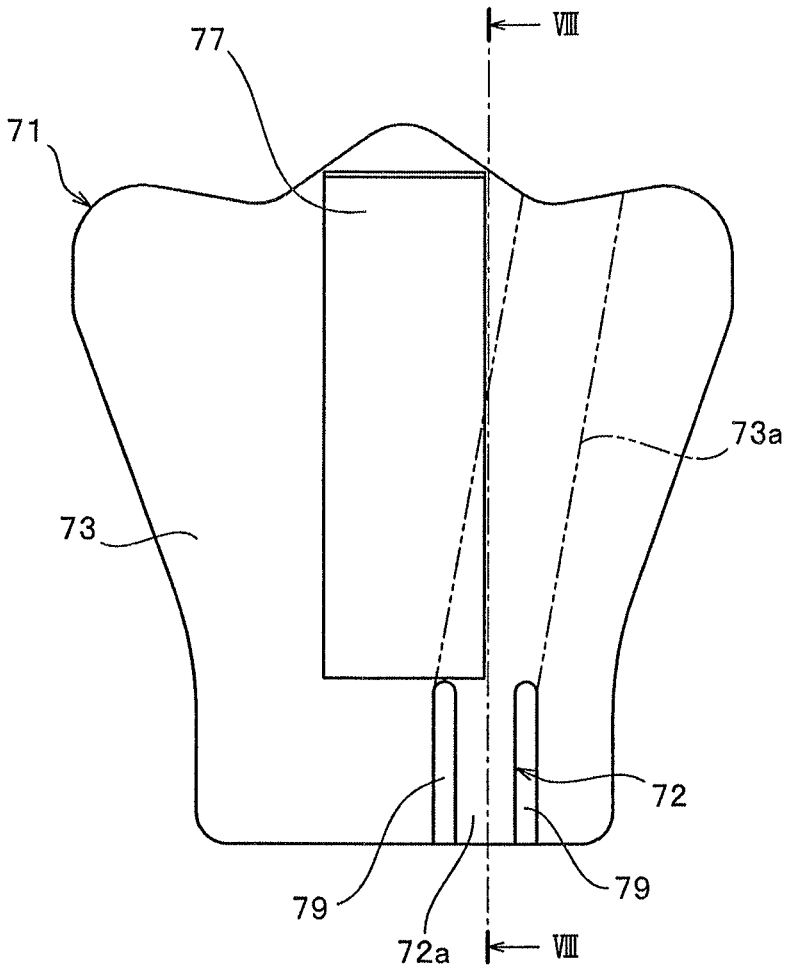
FIG. 7 is a front view of the slider according to a modification.
Figure 8:
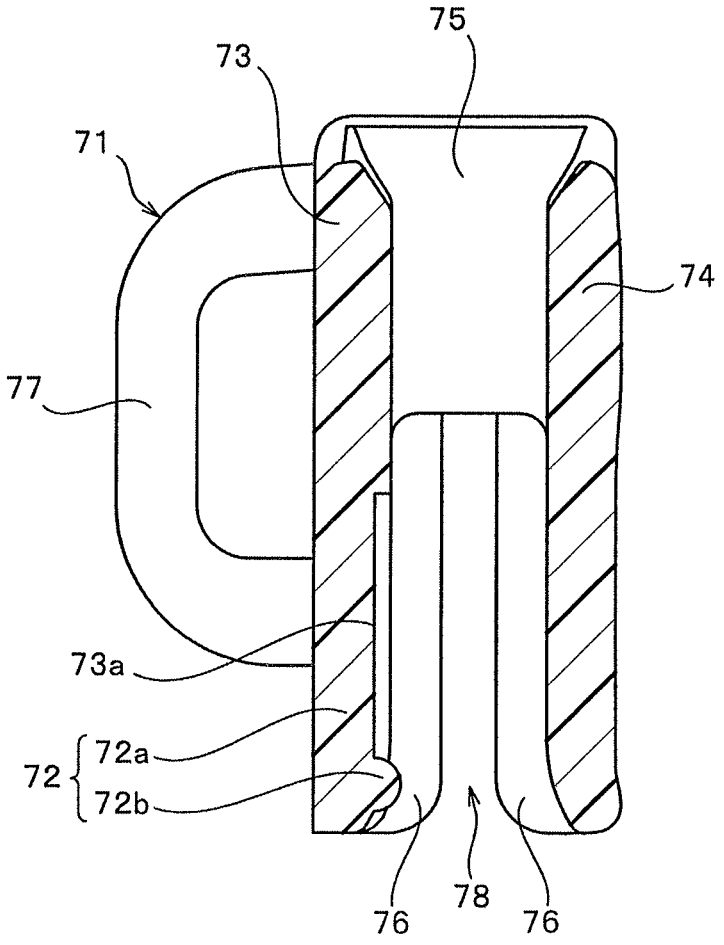
FIG. 8 is a sectional view along VIII-VIII line shown in FIG. 7.

The slider body 71 of a slider according to the first modification includes, as shown in FIGS. 7 and 8, upper and lower blades 73, 74, a connecting post 75 connecting front ends of the upper and lower blades 73, 74, a flange portion 76 extending from left and right side edges of the upper and lower blades 73, 74 in a direction closer to each other, a tab mounting post 77 provided upright on the upper blade 73, a set of two slits 79 provided in parallel from the posterior orifice side edge toward the front of the upper blade 73, the locking portion 72 provided between the slits 79, and a groove portion 73*a* provided on the inner surface of the upper blade 73.

The locking portion 72 in the first modification is provided integrally with the upper blade 73 and includes an elastic piece portion 72*a* extending backward from a closing side end of the slits 79 like being disposed between a pair of the slits 79 and a projecting portion 72*b* projecting downward from the inner surface of a tip portion of the elastic piece portion 72*a*.

In this case, the groove portion 73*a* provided in the upper blade 73 is disposed so as to overlap with the position of the elastic piece portion 72*a* and the thickness in the up and down direction of the elastic piece portion 72*a* is set thinner than the thickness of the upper blade 73 other than the elastic piece portion 72*a*. Accordingly, the elastic piece portion 72*a* is configured to be easily deformed elastically in the up and down direction. The elastic piece portion 72*a* can ensure a desired amount of elastic deformation by appropriately setting the material of the slider body 71, the length of the slit 79, the thickness of the elastic piece portion 72*a*, and the like.

The projecting portion 72*b* disposed in the tip portion of the elastic piece portion 72*a* is formed in such a way that a lower end position (tip position) of the projecting portion 72*b* is disposed on the side of the lower blade 74 from the position of a main inner wall surface of the upper blade 73 and the dimension in the up and down direction from the lower end position of the projecting portion 72*b* to the position of the main inner wall surface of the lower blade 74 is set smaller than the maximum value of the dimension in the up and down direction from the protuberance 15*e* on the upper surface side to the protuberance 15*e* on the lower surface side of the stopping element 15. Accordingly, when the stopping element 15 passes through an element guide passage 78, the projecting portion 72*b* of the locking portion 72 can reliably be caused to interfere with the protuberance (resistance portion) 15*e* of the stopping element 15.

Also in this case, the cut surface perpendicular to the left and right direction of the projecting portion 72*b* is formed in a semicircular shape and the projecting portion 72*b* of the locking portion 72 is thereby assisted in riding over the protuberance 15*e* of the stopping element 15 when the slider is operated with an appropriate force.

The groove portion 73*a* in the slider body 71 is disposed from the shoulder to the posterior orifice of the slider body 71 along the track through which the protuberance 15*e* of the stopping element 15 passes when the stopping element 15 passes through the element guide passage 78. In this case, the groove width and groove depth of the groove portion 73*a* is set in accordance with the size of the protuberance 15*e* disposed on the stopping element 15.

Figure 9:
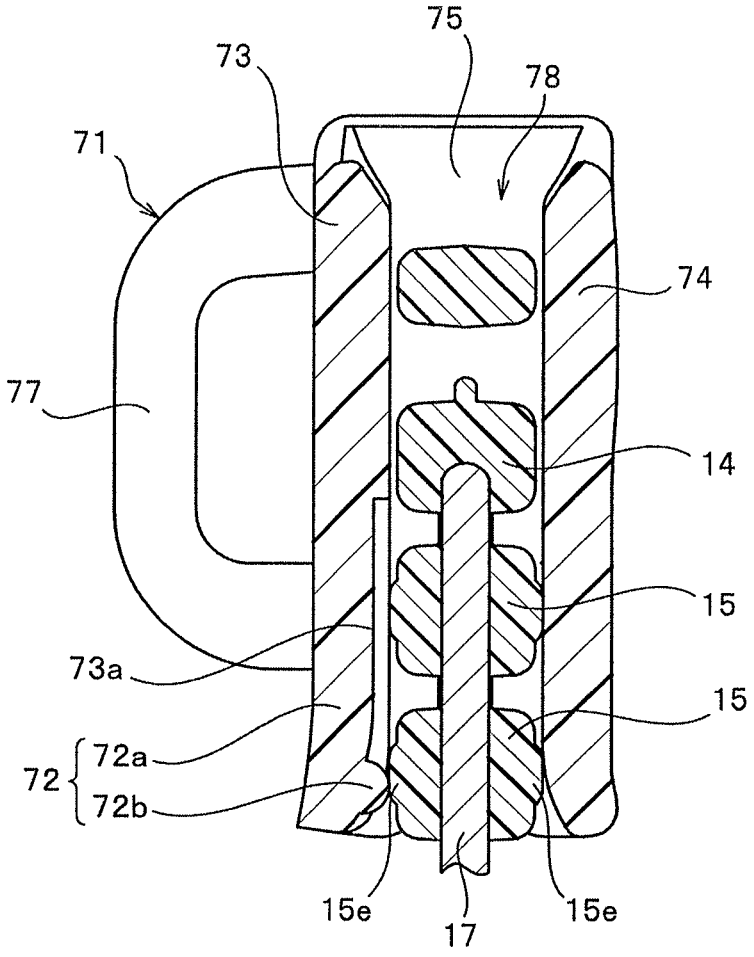
FIG. 9 is a sectional view showing a state in which a locking portion of the slider is elastically deformed.

If such a slider according to the first modification is used in place of a free slider of the slide fastener 1 according to the first embodiment, when, as shown in FIG. 9, the stopping element 15 advances into the element guide passage 78 of the slider according to the first modification, while the elastic piece portion 72*a* of the locking portion 72 disposed on the slider is deformed in the up and down direction, the projecting portion 72*b* of the locking portion 72 and the protuberance 15*e* of the stopping element 15 come into contact to generate large sliding resistance. Accordingly, the slider can be stopped and the immobilized state of the slider can be maintained.

In addition, a slider in the first modification is provided with the groove portion 73*a* as described above and therefore, when the stopping element 15 advances into the element guide passage 78 of the slider, the upper and lower blades 73, 74 and the protuberance 15*e* of the stopping element 15 are prevented from interfering with each other too much so that abrasion of the stopping element 15 and the slider due to interference can be suppressed.

Further, in a slider in the first modification, the locking portion 72 is provided integrally with the upper blade 73 and therefore, a slider in the first modification in which a tab is also formed integrally can be obtained in one injection molding process so that simplification of the manufacturing process of the slider and the reduction of manufacturing costs due to a reduced number of parts can be achieved.

The locking portion 72 in a slider according to the first modification is disposed at a posterior orifice side end of the upper blade 73, but the invention is not limited to such an example and the locking portion 72 may be arranged at a shoulder side end of the upper blade 73 or the locking portion 72 may be provided on the lower blade 74 only or both of the upper and lower blades 73, 74.

Further, the locking portion 72 and the groove portion 73*a* according to the first modification are provided corresponding to the stopping element 15 disposed on the element row 12 on one side, but according to the invention, the locking portion 72 and the groove portion 73*a* may be provided symmetrically with respect to the slider body 71 to correspond to the stopping elements 15 disposed on both of the left and right element rows 12.

Figure 10:
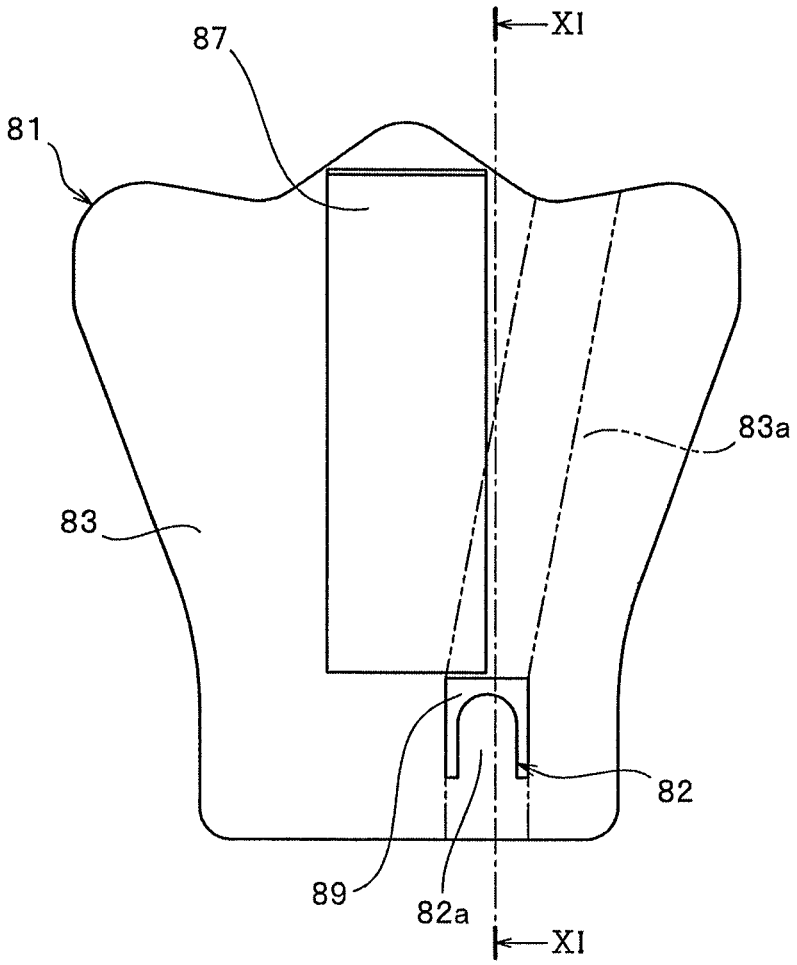
FIG. 10 is a front view showing the slider according to another modification.
Figure 11:
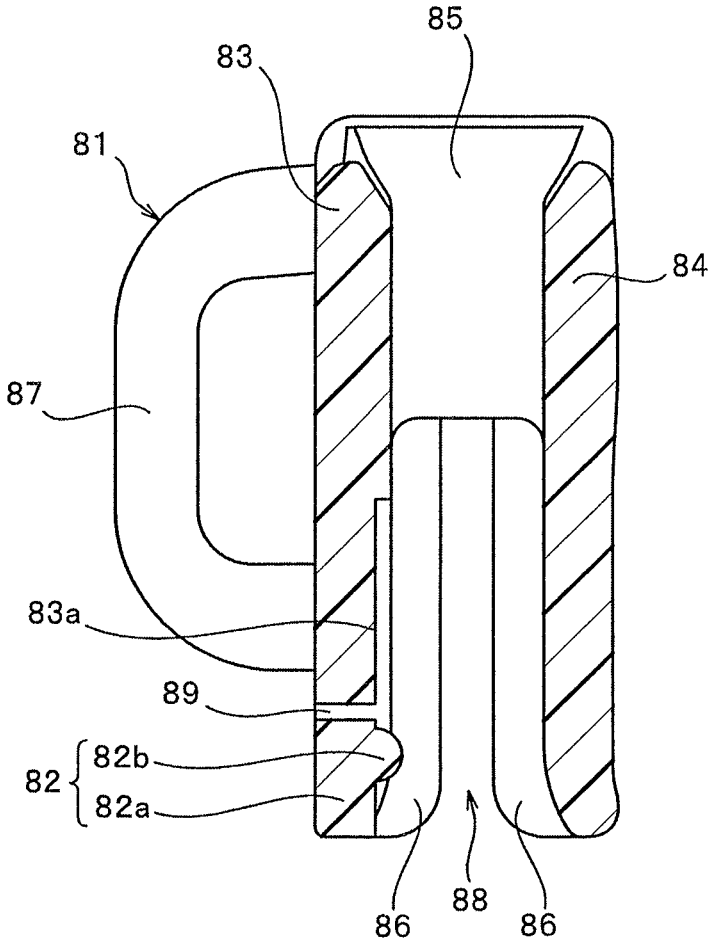
FIG. 11 is a sectional view along XI-XI line shown in FIG. 10.

Next, the slider body 81 of a slider according to the second modification is illustrated in FIGS. 10 and 11. The slider body 81 according to the second modification includes upper and lower blades 83, 84, a connecting post 85 connecting front ends of the upper and lower blades 83, 84, a flange portion 86 extending from left and right side edges of the upper and lower blades 83, 84 in a direction closer to each other, a tab mounting post 87 provided upright on the upper blade 83, a hole portion 89 drilled in a position closer to the posterior orifice side of the upper blade 83, the locking portion 82 disposed integrally with the upper blade 83 like being surrounded by the hole portion 89, and a groove portion 83*a* provided on the inner surface of the upper blade 83.

The hole portion 89 in the slider body 81 is provided by penetrating from the upper surface of the upper blade 83 to the inner wall surface side and presents a substantial U shape when viewed from the upper surface side in order to provide the locking portion 82 on the upper blade 83. The locking portion 82 in the second modification includes an elastic piece portion 82*a* disposed like extending into the hole portion 89 and a projecting portion 82*b* projecting downward from the inner surface of a tip portion of the elastic piece portion 82*a*.

In this case, the groove portion 83*a* provided in the upper blade 83 is disposed so as to overlap with the position of the elastic piece portion 82*a* and therefore, as in the first modification, the thickness in the up and down direction of the elastic piece portion 82*a* is set thinner than the thickness of the upper blade 83 other than the elastic piece portion 82*a* and also the elastic piece portion 82*a* is configured to be easily deformed elastically in the up and down direction.

The projecting portion 82*b* of the locking portion 82 is formed so that the lower end position (tip position) of the projecting portion 82*b* is disposed on the side of the lower blade 84 from the position of the main inner wall surface of the upper blade 83 and the dimension in the up and down direction from the lower end position of the projecting portion 82*b* to the position of the main inner wall surface of the lower blade 84 is set smaller than the maximum value of the dimension in the up and down direction from the protuberance 15*e* on the upper surface side to the protuberance 15*e* on the lower surface side of the stopping element 15. Further, the cut surface perpendicular to the left and right direction of the projecting portion 82*b* is formed in a semicircular shape.

The groove portion 83*a* in the slider body 81 is disposed, like in the first embodiment, from the shoulder to the posterior orifice of the slider body 81 along the track through which the protuberance 15*e* of the stopping element 15 passes when the stopping element 15 passes through an element guide passage 88.

Figure 12:
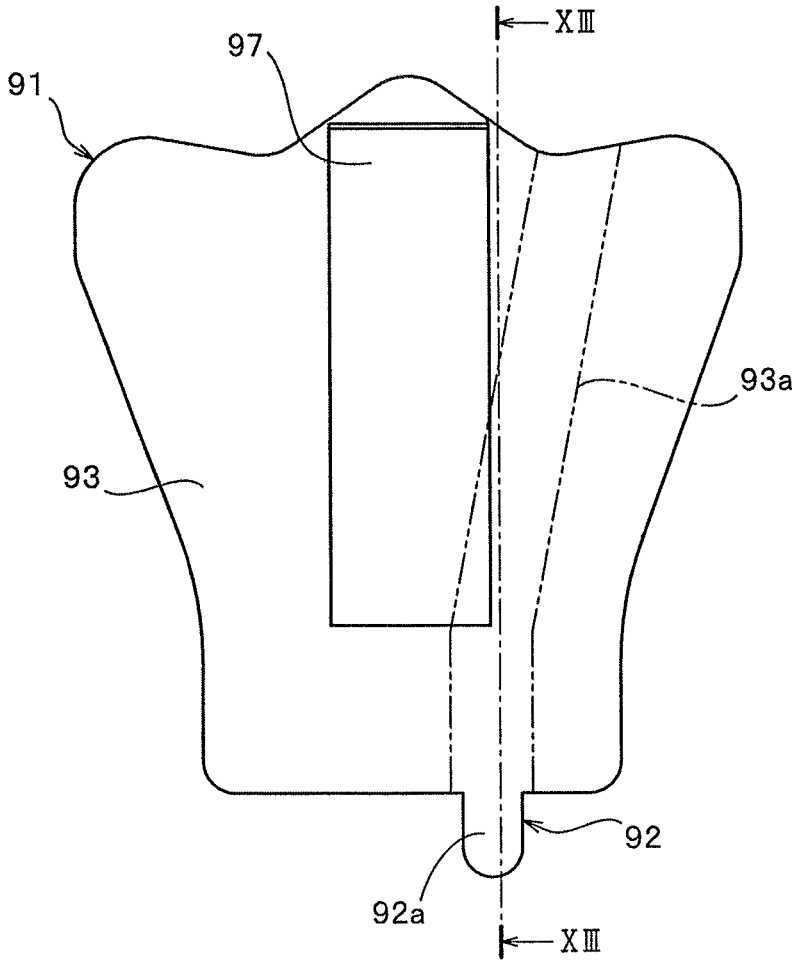
FIG. 12 is a front view showing the slider according to still another modification.
Figure 13:
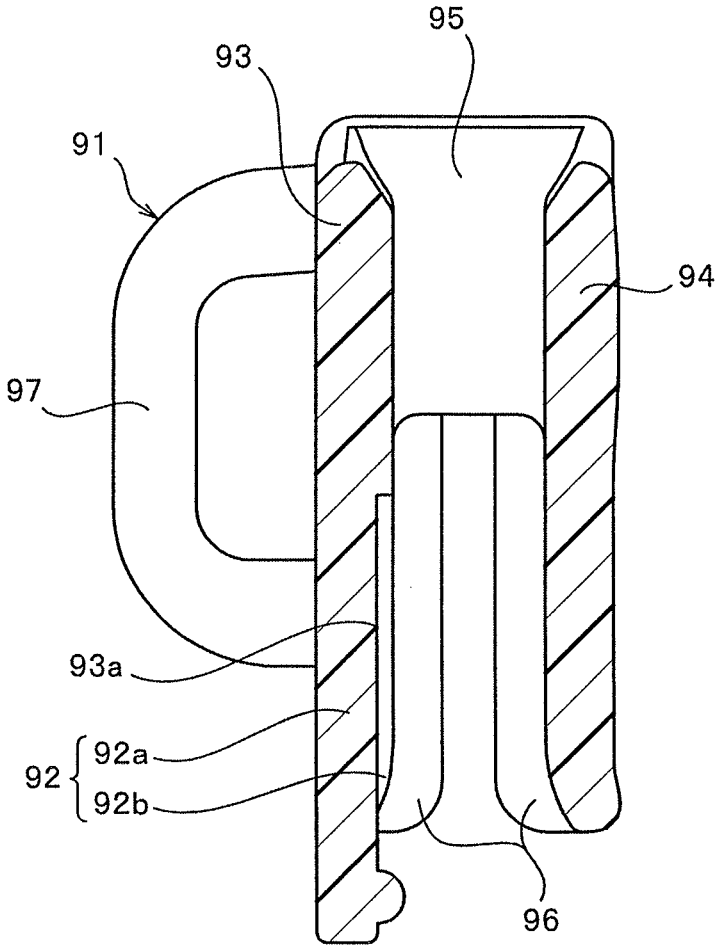
FIG. 13 is a sectional view along XIII-XIII line shown in FIG. 12.
Figure 14:
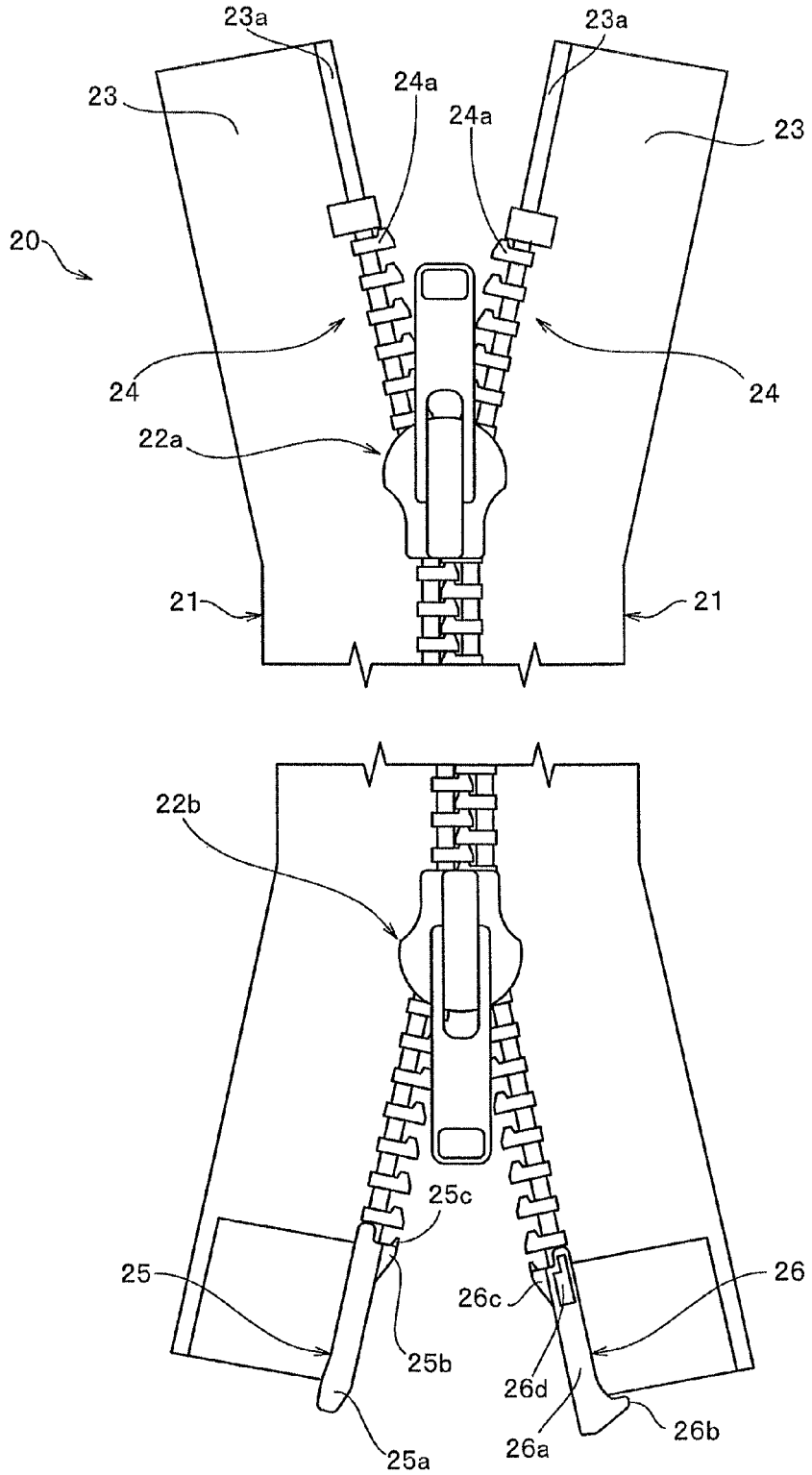
FIG. 14 is a front view showing a conventional slide fastener.

The slider body 91 of a slider according to the third modification is illustrated in FIGS. 12 and 13. The slider body 91 according to the third modification includes upper and lower blades 93, 94, a connecting post 95 connecting front ends of the upper and lower blades 93, 94, a flange portion 96 extending from left and right side edges of the upper and lower blades 93, 94 in a direction closer to each other, a tab mounting post 97 provided upright on the upper blade 93, the locking portion 92 disposed integrally at a posterior orifice side end of the upper blade 93, and a groove portion 93*a* provided on the inner surface of the upper blade 93.

The locking portion 92 in the third modification includes an elastic piece portion 92*a* extending backward from the posterior orifice side edge of the upper blade 93 and a projecting portion 92*b* projecting downward from the inner surface of the tip portion of the elastic piece portion 92*a*. In this case, the elastic piece portion 92*a* is disposed on an extension line of the groove portion 93*a* provided in the upper blade 93 and the thickness in the up and down direction of the elastic piece portion 92*a* is set thinner than the thickness of the upper blade 93 other than the elastic piece portion 92*a*.

The projecting portion 92*b* of the locking portion 92 is formed so that the lower end position (tip position) of the projecting portion 92*b* is disposed on the side of the lower blade 94 from the position of the main inner wall surface of the upper blade 93 and the dimension in the up and down direction from the lower end position of the projecting portion 92*b* to the position of the main inner wall surface of the lower blade 94 is set smaller than the maximum value of the dimension in the up and down direction from the protuberance 15*e* on the upper surface side to the protuberance 15*e* on the lower surface side of the stopping element 15. Further, the cut surface perpendicular to the left and right direction of the projecting portion 92*b* is formed in a semicircular shape.

If such a slider according to the second modification or a slider according to the third modification mentioned above is used in place of the free slider 30 of the slide fastener 1 according to the first embodiment, the same effect as that when a slider according to the first modification is used can be obtained.

DESCRIPTION OF REFERENCE NUMERALS

1 slide fastener
2 slide fastener
3 slide fastener
4 slide fastener
5 slide fastener
10 fastener stringer
11 fastener tape
11*a* tape main body portion
11*b* element attaching portion
12 element row
13 fastener element
14 normal element
15 stopping element
15*a* base
15*b* neck
15*c* coupling head
15*d* shoulder
15*e* protuberance
17 core thread portion
18 reinforcing film
30 slider
31 slider body
32 tab
33 upper blade
34 lower blade
35 connecting post
36 flange portion
37 tab mounting post
38 element guide passage
39 tape groove
40 separable bottom end stop
41 insert pin
42 box pin
43 box
51 stopping element
51*a* base 51*e* protuberance
52 stopping element
52*a* base
52*e* protuberance
53 stopping element
53*a* base
53*e* protuberance
54 stopping element
54*e* protuberance
55 stopping element
55*e* protuberance
56 stopping element
56*e* protuberance
57 stopping element
57*e* protuberance
58 stopping element
59 stopping element
59*a* base
59*f* fin portion
59*g* protuberance
60 stopping element
60*a* base
60*e* protuberance
60*f* fin portion
60*g* protuberance
61 stopping element
61*a* base
61*f* fin portion
62 stopping element
62*a* base
62*h* projection portion
63 stopping element
63*a* base
63*e* protuberance
63*i* first inclined plane
63*j* second inclined plane
71 slider body
72 locking portion
72*a* elastic piece portion
72*b* projecting portion
73 upper blade
73*a* groove portion
74 lower blade
75 connecting post
76 flange portion
77 tab mounting post
78 element guide passage
79 slit
81 slider body
82 locking portion
82*a* elastic piece portion
82*b* projecting portion
83 upper blade
83*a* groove portion
84 lower blade
85 connecting post
86 flange portion
87 tab mounting post
88 element guide passage
89 hole portion
91 slider body
92 locking portion
92*a* elastic piece portion
92*b* projecting portion
93 upper blade
93*a* groove portion
94 lower blade
95 connecting post
96 flange portion
97 tab mounting post

The invention claimed is:

1. A slide fastener comprising a pair of first and second stringers in which an element row is disposed on opposed tape side edges of first and second fastener tapes and a slider that can slide along the element rows, each of the element rows including a plurality of fastener elements attached to the tape side edges at predetermined intervals and the slider including upper and lower blades, a connecting post connecting the upper and lower blades, and a flange portion disposed on left and right side edges of at least one of the upper and lower blades, wherein at least one of the fastener elements is a stopping element, which includes a resistance portion capable of making the slider stop and capable of locking the slider by contacting an inner surface of the slider, the stopping element includes a base fixed to the tape side edge of the first and second fastener tapes, a neck extending outwards beyond the tape side edge and having a shape constricted in a tape length direction, and a coupling head disposed on a tip side of the neck and having a substantially oblong shape and a shoulder extending from a front and a back of the neck in opposing directions in the tape length direction from a center portion of the neck and in a tape front and rear direction; and a dimension in the tape front and rear direction of the stopping element including the resistance portion is larger than a dimension between the upper and lower blades of the slider, or a chain width when the element rows are coupled across the stopping element including the resistance portion is larger than a minimum interval between the left and right flange portions of the slider, wherein when the left and right element rows are coupled and the stopping element, including the resistance portion is within the slider, the slider stops.

2. The slide fastener according to claim 1, wherein the resistance portion is configured by at least one protuberance oriented in the tape front and rear direction of the stopping element and rising on at least one of a first surface and a second surface.

3. The slide fastener according to claim 1, wherein a portion with the largest dimension in the tape front and rear direction of the stopping element is disposed above a core thread portion of the first or second fastener tape.

4. The slide fastener according to claim 1, wherein each of the left and right side edges of the slider includes a tape groove configured to allow insertion of the first or the second fastener tape, and the resistance portion includes a fin portion with a dimension in the tape front and rear direction larger than a groove width of the tape groove.

5. The slide fastener according to claim 1, wherein the stopping element includes a projection portion projecting in a tape width direction on a wall surface of the base on a tape inner side, and the resistance portion makes the chain width including a projection edge of the projection portion when the element rows are coupled across the stopping element larger than the minimum interval between the left and right flange portions of the slider.

6. The slide fastener according to claim 1, wherein at least one of the stopping element and the slider is elastically deformable in the tape front and rear direction or the tape width direction.

7. The slide fastener according to claim 1, wherein the resistance portion has an inclined plane inclined in the tape length direction or a curved surface curved in the tape length direction.

8. The slide fastener according to claim 1, wherein at least two of the fastening elements are stopping elements and the stopping elements are disposed consecutively on one of the element rows in the tape length direction.

9. The slide fastener according to claim 1, wherein both of the element rows include at least one stopping element.

10. The slide fastener according to claim 1, wherein a separable bottom end stop is disposed on the first and second fastener stringers, and the stopping element is disposed on the element row on a side on which a box pin of the separable bottom end stop is disposed.

11. The slide fastener according to claim 1, wherein the stopping element is disposed at a position relative to an opening side end of the element row that is within 20% of a length of the element row, wherein the opening side end corresponds to an end of the element row where the fastener elements initially disengage when the slide fastener is opened.

12. The slide fastener according to claim 1, wherein the slider includes a locking portion provided integrally with at least one of the upper and lower blades to maintain an immobilized state of the slider by interfering with the stopping element, and the locking portion is configured to be elastically deformable in the tape front and rear direction.

13. The slide fastener according to claim 12, wherein the locking portion includes a projecting portion projecting toward an inner side in the tape front and rear direction from a main inner wall surface of the upper blade or the main inner wall surface of the lower blade.

14. The slide fastener according to claim 13, wherein a pair of slits cut from a posterior orifice side end or a shoulder side end is disposed on at least one of the upper and lower blades, and the projecting portion is disposed at a tip of an elastic piece portion is disposed between the slits.

15. The slide fastener according to claim 1, wherein a groove portion that avoids interference with the resistance portion is disposed on at least one of the upper and lower blades.

* * * * *